US009836925B2

(12) United States Patent
Vann

(10) Patent No.: US 9,836,925 B2
(45) Date of Patent: Dec. 5, 2017

(54) GAMING SYSTEMS, GAMING DEVICES AND METHODS WITH SYMBOL-BEARING REELS OF DISTINCT SIZES

(71) Applicant: Bally Gaming, Inc., Las Vegas, NV (US)

(72) Inventor: Jamie W. Vann, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 174 days.

(21) Appl. No.: 14/694,705

(22) Filed: Apr. 23, 2015

(65) Prior Publication Data

US 2016/0314661 A1 Oct. 27, 2016

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01); *G07F 17/3288* (2013.01)

(58) Field of Classification Search
CPC ..... G07F 17/34; G07F 17/3288; G07F 17/326
See application file for complete search history.

(56) References Cited

U.S. PATENT DOCUMENTS 6,517,433 B2 2/2003 Loose
8,057,303 B2 11/2011 Rasmussen
8,226,459 B2 7/2012 Barrett
2006/0046830 A1* 3/2006 Webb ..... G07F 17/3213 463/20
2010/0105474 A1* 4/2010 Shimizu ..... G07F 17/3211 463/32
2011/0201406 A1* 8/2011 Jaffe ..... G07F 17/32 463/21

* cited by examiner

*Primary Examiner* — William H McCulloch, Jr.
*Assistant Examiner* — Yingchuan Zhang
(74) *Attorney, Agent, or Firm* — David J. Bremer

(57) ABSTRACT

Presented herein are gaming systems, gaming machines, and methods for conducting wagering games. Gaming machines are disclosed which include a gaming cabinet, display device(s) and input device(s) coupled to the cabinet, and game-logic circuitry disposed within the cabinet. Game-logic circuitry is configured to: initiate a casino game responsive to an electronic data signal indicating receipt of a player's physical input; determine a wagering-game outcome from a random element generated by a random element generator; change a standard-sized reel into a multi-reel carriage carrying plural non-standard-sized symbol-bearing reels, each of which is rotatably mounted onto the carriage; display each non-standard-sized reel spinning contemporaneously with spinning of the standard-sized reels and carriage; display the wagering-game outcome, including symbols of the standard-sized and non-standard-sized reels populating array positions of an array; and, evaluate the symbols of the standard-sized and non-standard-sized reels in the array to determine if the outcome meets an award criterion.

20 Claims, 11 Drawing Sheets

GAMING SYSTEMS, GAMING DEVICES AND METHODS WITH SYMBOL-BEARING REELS OF DISTINCT SIZES

COPYRIGHT

A portion of the disclosure of this patent document contains materials which are subject to copyright protection. The copyright owner has no objection to the facsimile reproduction by anyone of the patent disclosure, as it appears in the Patent and Trademark Office patent files or records, but otherwise reserves all copyright rights whatsoever.

TECHNICAL FIELD

The present disclosure relates generally to electronic wagering game devices, casino gaming systems, gaming networks, and methods for conducting casino wagering games. More particularly, aspects of the present disclosure relate to systems, methods, and devices for conducting slot-type wagering games with symbol-bearing reels of distinct sizes.

BACKGROUND

Electronic gaming machines (EGM), such as slot machines, video poker machines, and the like, have become a cornerstone of the gaming industry. Generally, the popularity of such machines with players is dependent on the likelihood (or perceived likelihood) of winning money at the machine and the entertainment value of the machine relative to other available gaming options. Where the available gaming options include a number of competing machines, and the expectation of winning at each machine is roughly the same (or believed to be the same), players are typically attracted to the most engaging, entertaining and exciting machines. Shrewd operators consequently strive to employ technologically advanced gaming devices that can provide the most engaging, entertaining and exciting game features and enhancements because such devices attract frequent play and, hence, increase profitability to the operator. Thus, gaming manufacturers continuously endeavor to develop advanced gaming machines with improved gaming enhancements that will attract frequent play and player loyalty through enhanced entertainment value to the player.

A significant technical challenge is to improve the operation of gaming apparatuses and games played thereon, including the manner in which they leverage an underlying random element generator, by making them yield a negative return on investment in the long run (via a high quantity and/or frequency of player/apparatus interactions), and yet random and volatile enough to make players feel they can get lucky and win in the short run. Striking the right balance between yield versus randomness and volatility to create a feeling of luck involves addressing many technical problems, some of which can be at odds with one another. This "luck" factor is what appeals to core players and encourages prolonged and frequent player participation. As the industry matures, the creativity and ingenuity required to improve such operation of gaming apparatus and games grows accordingly.

Conventional slot-type wagering games include plural symbol-bearing reels, each of which has a plurality of distinct reel positions populated by a variety of different types of symbols. Traditionally, slot-type gaming machines display randomly determined outcomes that are represented to the player by select symbols on the symbol-bearing reels, and award players for game outcomes with winning symbols and combinations of symbols in accordance with a pay table. To enhance player entertainment and excitement, some slot-type gaming machines have employed "clumping" of symbols, where a "clump" can be typified as a group of identical symbols that appear adjacent one another on the same reel. For some implementations, a symbol clump consists of a single, elongated symbol—sometime referred to as a "picture symbol" or "picture clump"—that occupies multiple adjacent reel positions on the same reel. Another example is the "mega symbol" clump, which historically consists of a single, enlarged symbol that occupies both multiple adjacent reel positions on the same reel and multiple adjacent reel positions on at least two neighboring reels. By occupying multiple adjacent reel positions with one or more of the same symbols, a symbol clump typically increases the likelihood of achieving a winning outcome and, thus, winning a corresponding award.

In general, the number of symbol clumps on a given reel, if any, as well as the respective location and size of each symbol clump are customarily preset and unchangeable. Additionally, given the increased likelihood of a winning outcome, clumps are oftentimes permanently assigned to symbols corresponding to lower award values on the pay table. Like the fixed location and size of a particular clump, the overall number of mega symbols available in a given wagering game for populating the array positions as part of an outcome is customarily preset and unchangeable (i.e., the number of mega symbols remains the same from play to play). Because a conventional mega symbol is assigned to multiple neighboring reels, which can require that these reels be indexed to spin in unison, the overall number of mega symbols is limited to ensure there are reels that spin individually. Reel positions above and below most mega symbols are populated by standard-sized symbols (e.g., symbols occupying a single reel position) to control the game's volatility and expected value. Because symbol clumping offers tremendous advantages in player appeal and excitement relative to other known features, and because such games are attractive to both players and operators, there is a continuing need to develop gaming systems with new types of games to satisfy the demands of players and operators.

SUMMARY

Aspects of the present disclosure are directed to electronic gaming devices, gaming systems and networks, methods of conducting wagering games, and game-logic circuitry with executable instructions for conducting wagering games with mega symbols. Disclosed, for example, is a casino wagering game with multiple standard-sized symbol-bearing reels (e.g., five individually spinnable reels) arranged in an array of symbol positions (e.g., a 12×5 matrix). Each "standard" reel operates to populate a single column of the array; cooperatively, these reels populate the entire array with symbols to indicate randomly determined outcomes of the wagering game. Paylines traversing, for example, left-to-right across the reels are used to evaluate these outcomes for winning symbol combinations, in at least some embodiments. During game play, at least one of the standard-sized reels (e.g., the three center reels of the five-reel example) are replaced with or transform into an expanded "king" carriage which carries plural mega-symbol-bearing "king" reels. This transformation may take place systematically or randomly, for example, on any given play of the wagering game. Each of the king-sized reels is rotatably mounted onto the king-sized carriage such that the king reels spin independently of one another while the expanded king carriage also spins. The mega symbols operate to populate numerous symbol positions of the array when part of a game outcome. By way of example, a mega symbol can populate up to 12 symbol positions across three adjacent rows and four neighboring columns of the array. One or more or all of the king-sized reels borne by the king carriage can be replaced by multiple individually spinnable "mini" reels, each of which operates to populate a subsection of a single column of the array (e.g., four of the twelve symbol positions in one column). All of the reels, both standard-sized and king-sized, contribute to and, thus, are evaluated as part of the final game outcome. Additional methods of evaluation, both traditional and non-traditional, may be employed when the king reels are triggered, including vertical evaluations, scatter evaluations, right-to-left pays, etc.

Aspects of the present disclosure are directed to electronic gaming machines (EGM), such as electro-mechanical casino slot machines, for conducting wagering games. For example, disclosed herein is an EGM that is primarily dedicated to conducting at least one regulated casino wagering game. The EGM includes a gaming cabinet for housing electronic components associated with a casino wagering game. An electronic display device is coupled to the gaming cabinet and configured to display the casino wagering game, which includes a plurality of first "standard-sized" symbol-bearing reels. Moreover, an electronic input device, which is also coupled to the gaming cabinet, is configured to receive a physical input from a player to initiate the casino wagering game, and then transform the physical input into an electronic data signal. Game-logic circuitry is disposed within the gaming cabinet. This game-logic circuitry includes a random element generator that generates one or more random elements associated with play of the casino wagering game.

The EGM's game-logic circuitry is configured to: receive from the electronic input device an electronic data signal indicating receipt of a physical input to initiate the casino wagering game; initiate the casino wagering game in response to the electronic data signal generated by the electronic input device; determine an outcome of the casino wagering game based, at least in part, on one or more random elements generated by the random element generator; change at least one of the standard-sized reels into a multi-reel carriage that carries plural second "non-standard-sized" symbol-bearing reels, each of which is rotatably mounted onto the multi-reel carriage; direct the electronic display device to display the non-standard-sized reels spinning individually and contemporaneously with the spinning of the standard-sized reels and multi-reel carriage; direct the electronic display device to display the randomly determined outcome of the casino wagering game, the outcome including symbols borne by the standard-sized reels and non-standard-sized reels populating a plurality of distinct array positions arranged in an array on the display device; evaluate the symbols of the standard-sized reels and the non-standard-sized reels populating the array; and, transmit an award to the player if the outcome meets at least one predetermined award criterion.

Other aspects of the present disclosure are directed to gaming systems for conducting wagering games. For example, disclosed is a gaming system that is primarily dedicated to conducting at least one regulated casino wagering game. The gaming system includes an electronic gaming machine (EGM) with a gaming cabinet, an electronic display device, and an electronic input device. The gaming cabinet of the gaming machine is constructed to house components associated with the wagering game. The electronic display device and the electronic input device are operatively attached to the gaming cabinet. The electronic input device is configured to receive a physical input from a player to initiate the wagering game and transform the input into an electronic data signal. The gaming system also includes game-logic circuitry and an electronic random element generator, which is configured to generate one or more random elements associated with play of the wagering game.

The gaming system's game-logic circuitry is configured to: receive from the electronic input device the electronic data signal indicating receipt of the physical input from the player to initiate the wagering game; initiate the wagering game in response to the electronic data signal generated by the electronic input device; determine an outcome of the wagering game based, at least in part, on the one or more random elements generated by the random element generator; change at least one standard-sized symbol-bearing reel of the waging game into a multi-reel carriage carrying a plurality of non-standard-sized symbol-bearing reels, each of the non-standard-sized reels being rotatably mounted onto the multi-reel carriage; direct the electronic display device to display the non-standard-sized reels spinning individually and contemporaneously with the spinning of the standard-sized reels and multi-reel carriage; direct the electronic display device to display the randomly determined outcome of the casino wagering game, the outcome including symbols borne by the standard-sized and non-standard-sized reels populating plural distinct array positions arranged in an array displayed on the display device; evaluate the symbols of the standard-sized reels and the non-standard-sized reels populating the array; and, transmit an award to the player in response to the outcome meeting a predetermined award criterion.

Additional aspects of this disclosure are directed to computer-implemented methods, programmable game-logic circuitry, and game content engines for conducting wagering games. In an example, disclosed herein is a method of operating a gaming system primarily dedicated to playing at least one regulated casino wagering game. The gaming system includes an electronic random element generator, game-logic circuitry, and an electronic gaming machine. The electronic gaming machine includes a gaming cabinet, an electronic display device, and an electronic input device. The gaming cabinet is constructed to house components associated with the casino wagering game.

The method includes: receiving, from the electronic input device of the electronic gaming machine, an electronic data signal indicating receipt of a physical input from a player as an indication of a wager to initiate the casino wagering game; generating, in response to the electronic data signal received from the electronic input device, one or more random elements with the electronic random element generator; determining, via the game-logic circuitry, an outcome of the casino wagering game based, at least in part, on the one or more random elements; changing, in response to a triggering event during play of the casino wagering game, at least one of the standard-sized reels of the wagering game into a multi-reel carriage carrying a plurality of non-standard-sized symbol-bearing reels, each of the non-standard-sized reels being rotatably mounted onto the multi-reel carriage; displaying, via the electronic display device, the non-standard-sized reels spinning individually and contemporaneously with spinning of the standard-sized reels and the multi-reel carriage; displaying, via the electronic display device, the randomly determined outcome of the casino wagering game, the outcome including symbols borne by the standard-sized reels and the non-standard-sized reels populating a plurality of distinct array positions arranged in an array on the display device; and, evaluating, via the game-logic circuitry, the symbols of the standard-sized reels and the non-standard-sized reels populating the array to determine if the outcome of the casino wagering game meets at least one predetermined award criterion.

The above summary does not represent every embodiment or every aspect of the present disclosure. Rather, the foregoing summary merely provides an exemplification of some of the novel aspects and features set forth herein. The above features and advantages, and other features and advantages of the present disclosure, will be readily apparent from the following detailed description of representative embodiments and modes for carrying out the present invention when taken in connection with the accompanying drawings and the appended claims.

Figure 1:
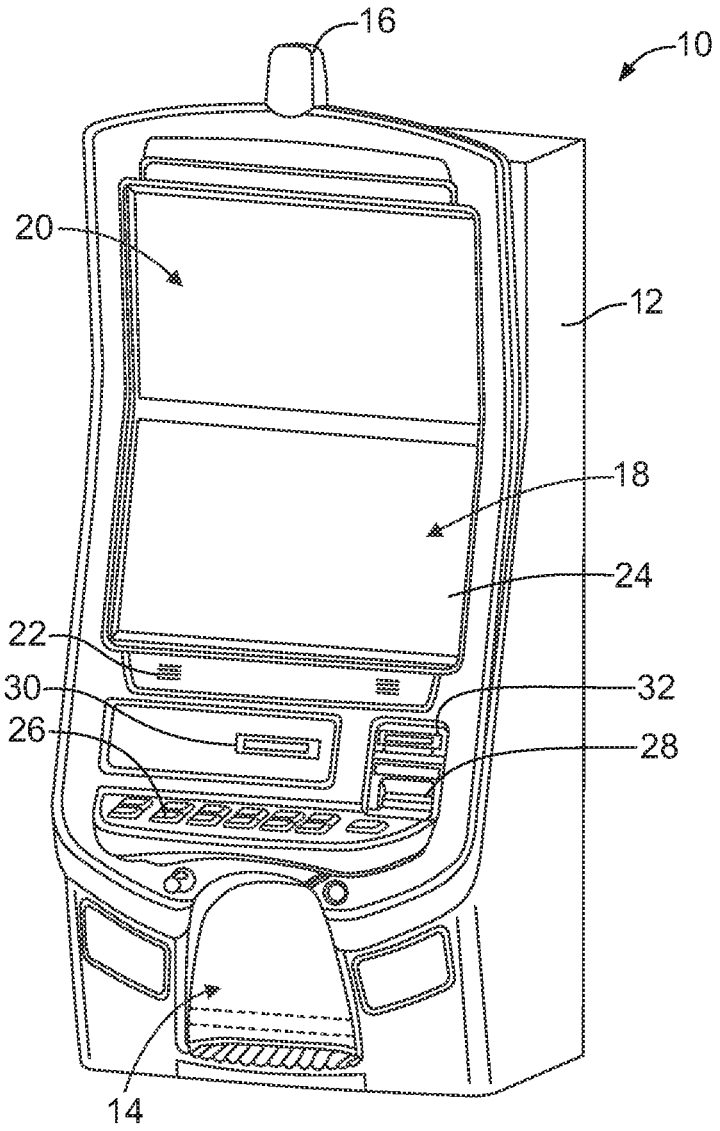
FIG. 1 is a perspective-view illustration of a representative free-standing electronic gaming machine (EGM) according to aspects of the present disclosure.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, the disclosure is to cover all modifications, equivalents, and alternatives falling within the spirit and scope of the invention as defined by the appended claims.

DETAILED DESCRIPTION OF ILLUSTRATED EXAMPLES

This disclosure is susceptible of embodiment in many different forms. There are shown in the drawings, and will herein be described in detail, representative embodiments with the understanding that the present disclosure is to be considered as an exemplification of the principles of the present disclosure and is not intended to limit the broad aspects of the disclosure to the embodiments illustrated. To that extent, elements and limitations that are disclosed, for example, in the Abstract, Summary, and Detailed Description sections, but not explicitly set forth in the claims, should not be incorporated into the claims, singly or collectively, by implication, inference or otherwise. For purposes of the present detailed description, unless specifically disclaimed or logically prohibited: the singular includes the plural and vice versa; and the words "including" or "comprising" or "having" means "including without limitation." Moreover, words of approximation, such as "about," "almost," "substantially," "approximately," and the like, can be used herein in the sense of "at, near, or nearly at," or "within 3-5% of," or "within acceptable manufacturing tolerances," or any logical combination thereof, for example."

For purposes of the present detailed description, the terms "wagering game," "casino wagering game," "gambling," "slot game," "casino game," and the like include games in which a player places at risk a sum of money or other representation of value, whether or not redeemable for cash, on an event with an uncertain outcome, including without limitation those having some element of skill. In some embodiments, the wagering game involves wagers of real money, as found with typical land-based or online casino games. In other embodiments, the wagering game additionally, or alternatively, involves wagers of non-cash values, such as virtual currency, and therefore may be considered a social or casual game, such as would be typically available on a social networking web site, other web sites, across computer networks, or applications on mobile devices (e.g., phones, tablets, etc.). When provided in a social or casual game format, the wagering game may closely resemble a traditional casino game, or it may take another form that more closely resembles other types of social/casual games.

Referring to the drawings, wherein like reference numerals refer to like features throughout the several views, there is shown in FIG. 1 an electronic gaming machine (EGM), designated generally at 10, similar to those operated in gaming establishments, such as casinos. With regard to the present disclosure, the gaming machine 10 may be any type of gaming terminal or machine ("gaming terminal" and "gaming machine" and "gaming device" being used interchangeably in this disclosure) and may have varying structures and methods of operation. For example, in some aspects, the gaming machine 10 is an electromechanical gaming terminal configured to play slots with mechanical reels, whereas in other aspects, the gaming machine is an electronic gaming terminal configured to play a video casino game, such as slots, keno, poker, blackjack, roulette, craps, etc. The gaming machine 10 may take any suitable form, such as floor-standing models (as shown), handheld mobile gaming units, bartop gaming models, workstation-type console models, etc. Further, the gaming machine 10 may be primarily dedicated for use in playing casino wagering games, or may include non-dedicated devices, such as mobile phones, personal digital assistants, personal computers, etc. Exemplary types of gaming machines are disclosed in U.S. Pat. Nos. 6,517,433, 8,057,303, and 8,226,459, all of which are incorporated herein by reference in their respective entireties and for all purposes.

The gaming machine 10 illustrated in FIG. 1 comprises a gaming cabinet 12 that securely houses various input devices, output devices, input/output devices, internal electronic/electromechanical components, and wiring. The cabinet 12 includes exterior walls, interior walls and shelves for mounting the internal components and managing the wiring, and one or more front doors that are locked and require a physical or electronic key to gain access to the interior compartment of the cabinet 12 behind the locked door. The cabinet 12 forms an alcove 14 configured to store one or more beverages or personal items of a player. A notification mechanism 16, such as a candle or tower light, is mounted to the top of the cabinet 12. It flashes to alert an attendant that change is needed, a hand pay is requested, or there is a potential problem with the gaming machine 10.

The input devices, output devices, and input/output devices are disposed on, and securely coupled to, the cabinet 12. By way of example, the output devices include a primary display 18, a secondary display 20, and one or more audio speakers 22. The primary display 18 or the secondary display 20 may be a mechanical-reel display device, a video display device, or a combination thereof in which a transmissive video display is disposed in front of the mechanical-reel display to portray a video image superimposed upon the mechanical-reel display. The displays variously display information associated with wagering games, non-wagering games, community games, progressives, advertisements, services, premium entertainment, text messaging, emails, alerts, announcements, broadcast information, subscription information, etc. appropriate to the particular mode(s) of operation of the gaming machine 10. The gaming machine 10 includes a touch screen(s) 24 mounted over the primary or secondary displays, buttons 26 on a button panel, a bill/ticket acceptor 28, a card reader/writer 30, a ticket dispenser 32, and player-accessible ports (e.g., audio output jack for headphones, video headset jack, USB port, wireless transmitter/receiver, etc.). It should be understood that numerous other peripheral devices and other elements exist and are readily utilizable in any number of combinations to create various forms of a gaming machine in accord with the present concepts.

The player input devices, such as the touch screen 24, buttons 26, a mouse, a joystick, a gesture-sensing device, a voice-recognition device, and a virtual-input device, accept player inputs and transform the player inputs to electronic data signals indicative of the player inputs, which correspond to an enabled feature for such inputs at a time of activation (e.g., pressing a "Max Bet" button or soft key to indicate a player's desire to place a maximum wager to play the wagering game). The inputs, once transformed into electronic data signals, are output to game-logic circuitry for processing. The electronic data signals are selected from a group consisting essentially of an electrical current, an electrical voltage, an electrical charge, an optical signal, an optical element, a magnetic signal, and a magnetic element.

The gaming machine 10 includes one or more value input/payment devices and value output/payout devices. The value input devices are used to deposit cash or credits onto the gaming machine 10. The cash or credits are used to fund wagers placed on the wagering game played via the gaming machine 10. Examples of value input devices include, but are not limited to, a coin acceptor, the bill/ticket acceptor 28, the card reader/writer 30, a wireless communication interface for reading cash or credit data from a nearby mobile device, and a network interface for withdrawing cash or credits from a remote account via an electronic funds transfer. The value output devices are used to dispense cash or credits from the gaming machine 10. The credits may be exchanged for cash at, for example, a cashier or redemption station. Examples of value output devices include, but are not limited to, a coin hopper for dispensing coins or tokens, a bill dispenser, the card reader/writer 30, the ticket dispenser 32 for printing tickets redeemable for cash or credits, a wireless communication interface for transmitting cash or credit data to a nearby mobile device, and a network interface for depositing cash or credits to a remote account via an electronic funds transfer.

Figure 2:
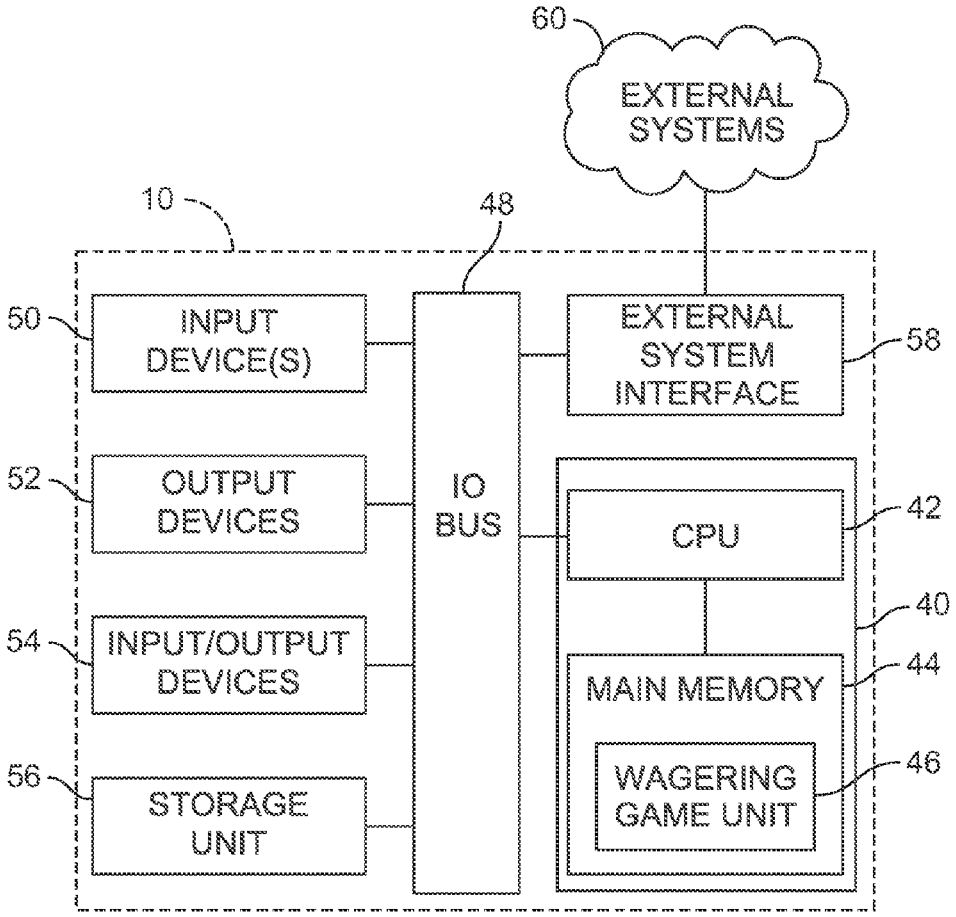
FIG. 2 is a schematic diagram of a representative electronic gaming machine (EGM) in a networked gaming system according to aspects of the present disclosure.

Turning now to FIG. 2, there is shown a block diagram of the gaming-machine architecture. The gaming machine 10 includes game-logic circuitry 40 securely housed within a locked box inside the gaming cabinet 12 (see FIG. 1). The game-logic circuitry 40 includes a central processing unit (CPU) 42 connected to a main memory 44 that comprises one or more memory devices. The CPU 42 includes any suitable processor(s), such as those made by Intel and AMD. By way of example, the CPU 42 includes a plurality of microprocessors including a master processor, a slave processor, and a secondary or parallel processor. Game-logic circuitry 40, as used herein, comprises any combination of hardware, software, or firmware disposed in or outside of the gaming machine 10 that is configured to communicate with or control the transfer of data between the gaming machine 10 and a bus, another computer, processor, device, service, or network. The game-logic circuitry 40, and more specifically the CPU 42, comprises one or more controllers or processors and such one or more controllers or processors need not be disposed proximal to one another and may be located in different devices or in different locations. The game-logic circuitry 40, and more specifically the main memory 44, comprises one or more memory devices which need not be disposed proximal to one another and may be located in different devices or in different locations. The game-logic circuitry 40 is operable to execute all of the various gaming methods and other processes disclosed herein. The main memory 44 includes a wagering-game unit 46. In one embodiment, the wagering-game unit 46 causes wagering games to be presented, such as video poker, video black jack, video slots, video lottery, etc., in whole or part.

The game-logic circuitry 40 is also connected to an input/output (I/O) bus 48, which can include any suitable bus technologies, such as an AGTL+ frontside bus and a PCI backside bus. The I/O bus 48 is connected to various input devices 50, output devices 52, and input/output devices 54 such as those discussed above in connection with FIG. 1. The I/O bus 48 is also connected to a storage unit 56 and an external-system interface 58, which is connected to external system(s) 60 (e.g., wagering-game networks).

The external system 60 includes, in various aspects, a gaming network, other gaming machines or terminals, a gaming server, a remote controller, communications hardware, or a variety of other interfaced systems or components, in any combination. In yet other aspects, the external system 60 comprises a player's portable electronic device (e.g., cellular phone, electronic wallet, etc.) and the external-system interface 58 is configured to facilitate wireless communication and data transfer between the portable electronic device and the gaming machine 10, such as by a near-field communication path operating via magnetic-field induction or a frequency-hopping spread spectrum RF signals (e.g., Bluetooth, etc.).

The gaming machine 10 optionally communicates with the external system 60 such that the gaming machine 10 operates as a thin, thick, or intermediate client. The game-logic circuitry 40—whether located within ("thick client"), external to ("thin client"), or distributed both within and external to ("intermediate client") the gaming machine 10—is utilized to provide a wagering game on the gaming machine 10. In general, the main memory 44 stores programming for a random number generator (RNG), game-outcome logic, and game assets (e.g., art, sound, etc.)—all of which obtained regulatory approval from a gaming control board or commission and are verified by a trusted authentication program in the main memory 44 prior to game execution. The authentication program generates a live authentication code (e.g., digital signature or hash) from the memory contents and compare it to a trusted code stored in the main memory 44. If the codes match, authentication is deemed a success and the game is permitted to execute. If, however, the codes do not match, authentication is deemed a failure that must be corrected prior to game execution. Without this predictable and repeatable authentication, the gaming machine 10, external system 60, or both, are not allowed to perform or execute the RNG programming or game-outcome logic in a regulatory-approved manner and are therefore unacceptable for commercial use. In other words, through the use of the authentication program, the game-logic circuitry facilitates operation of the game in a way that a person making calculations or computations could not.

When a wagering-game instance is executed, the CPU 42 (comprising one or more processors or controllers) executes the RNG programming to generate one or more pseudo-random numbers. The pseudo-random numbers are divided into different ranges, and each range is associated with a respective game outcome. Accordingly, the pseudo-random numbers are utilized by the CPU 42 when executing the game-outcome logic to determine a resultant outcome for that instance of the wagering game. The resultant outcome is then presented to a player of the gaming machine 10 by accessing the associated game assets, required for the resultant outcome, from the main memory 44. The CPU 42 causes the game assets to be presented to the player as outputs from the gaming machine 10 (e.g., audio and video presentations). Instead of a pseudo-RNG, the game outcome may be derived from random numbers generated by a physical RNG that measures some physical phenomenon that is expected to be random and then compensates for possible biases in the measurement process. Whether the RNG is a pseudo-RNG or physical RNG, the RNG uses a seeding process that relies upon an unpredictable factor (e.g., human interaction of turning a key) and cycles continuously in the background between games and during game play at a speed that cannot be timed by the player, for example, at a minimum of 100 Hz (100 calls per second) as set forth in Nevada's New Gaming Device Submission Package. Accordingly, the RNG cannot be carried out manually by a human and is integral to operating the game.

The gaming machine 10 may be used to play central determination games, such as electronic pull-tab and bingo games. In an electronic pull-tab game, the RNG is used to randomize the distribution of outcomes in a pool and/or to select which outcome is drawn from the pool of outcomes when the player requests to play the game. In an electronic bingo game, the RNG is used to randomly draw numbers that players match against numbers printed on their electronic bingo card.

The gaming machine 10 may include additional peripheral devices or more than one of each component shown in FIG. 2. Any component of the gaming-machine architecture includes hardware, firmware, or tangible machine-readable storage media including instructions for performing the operations described herein. Machine-readable storage media includes any mechanism that stores information and provides the information in a form readable by a machine (e.g., gaming terminal, computer, etc.). For example, machine-readable storage media includes read only memory (ROM), random access memory (RAM), magnetic-disk storage media, optical storage media, flash memory, etc.

Figure 3:
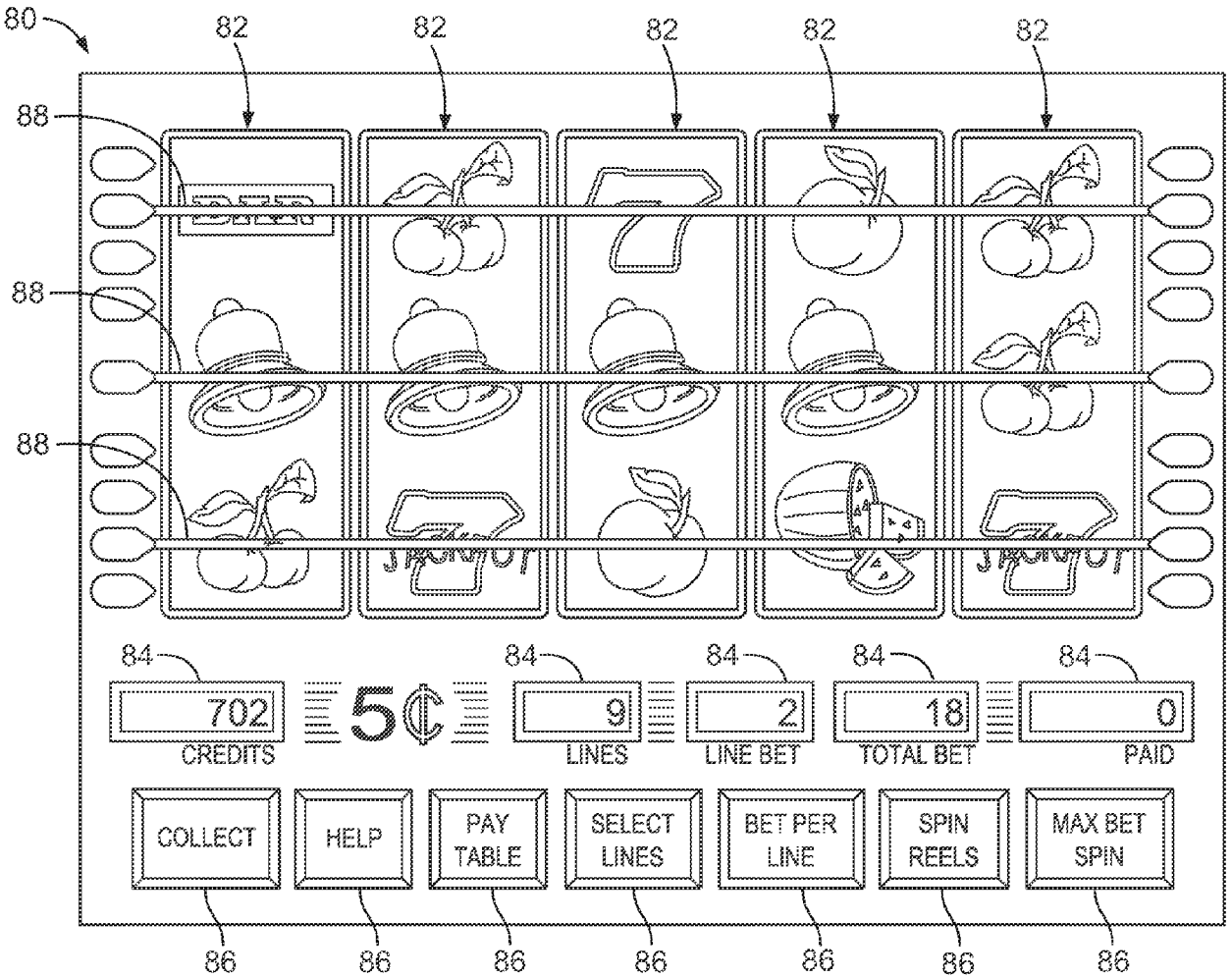
FIG. 3 is a screen shot of a representative basic-game screen of a casino game displayed on a dedicated casino gaming device according to aspects of the present disclosure.

Referring now to FIG. 3, there is illustrated an image of a basic-game screen 80 adapted to be displayed on the primary display 18 or the secondary display 20. The basic-game screen 80 portrays a plurality of simulated symbol-bearing reels 82. Alternatively or additionally, the basic-game screen 80 portrays a plurality of mechanical reels or other video or mechanical presentation consistent with the game format and theme. The basic-game screen 80 also advantageously displays one or more game-session credit meters 84 and various touch screen buttons 86 adapted to be actuated by a player. A player can operate or interact with the wagering game using these touch screen buttons or other input devices such as the buttons 26 shown in FIG. 1. The game-logic circuitry 40 operates to execute a wagering-game program causing the primary display 18 or the secondary display 20 to display the wagering game.

In response to receiving an input indicative of a wager, the reels 82 are rotated and stopped to place symbols on the reels in visual association with paylines such as paylines 88. The wagering game evaluates the displayed array of symbols on the stopped reels and provides immediate awards and bonus features in accordance with a pay table. The pay table may, for example, include "line pays" or "scatter pays." Line pays occur when a predetermined type and number of symbols appear along an activated payline, typically in a particular order such as left to right, right to left, top to bottom, bottom to top, etc. Scatter pays occur when a predetermined type and number of symbols appear anywhere in the displayed array without regard to position or paylines. Similarly, the wagering game may trigger bonus features based on one or more bonus triggering symbols appearing along an activated payline (i.e., "line trigger") or anywhere in the displayed array (i.e., "scatter trigger"). The wagering game may also provide mystery awards and features independent of the symbols appearing in the displayed array.

In accord with various methods of conducting a wagering game on a gaming system in accord with the present concepts, the wagering game includes a game sequence in which a player makes a wager and a wagering-game outcome is provided or displayed in response to the wager being received or detected. The wagering-game outcome, for that particular wagering-game instance, is then revealed to the player in due course following initiation of the wagering game. The method comprises the acts of conducting the wagering game using a gaming apparatus, such as the gaming machine 10 depicted in FIG. 1, following receipt of an input from the player to initiate a wagering-game instance. The gaming machine 10 then communicates the wagering-game outcome to the player via one or more output devices (e.g., primary display 18 or secondary display 20) through the display of information such as, but not limited to, text, graphics, static images, moving images, etc., or any combination thereof. In accord with the method of conducting the wagering game, the game-logic circuitry 40 transforms a physical player input, such as a player's pressing of a "Spin Reels" touch key, into an electronic data signal indicative of an instruction relating to the wagering game (e.g., an electronic data signal bearing data on a wager amount).

In the aforementioned method, for each data signal, the game-logic circuitry 40 is configured to process the electronic data signal, to interpret the data signal (e.g., data signals corresponding to a wager input), and to cause further actions associated with the interpretation of the signal in accord with stored instructions relating to such further actions executed by the controller. As one example, the CPU 42 causes the recording of a digital representation of the wager in one or more storage media (e.g., storage unit 56), the CPU 42, in accord with associated stored instructions, causes the changing of a state of the storage media from a first state to a second state. This change in state is, for example, effected by changing a magnetization pattern on a magnetically coated surface of a magnetic storage media or changing a magnetic state of a ferromagnetic surface of a magneto-optical disc storage media, a change in state of transistors or capacitors in a volatile or a non-volatile semiconductor memory (e.g., DRAM, etc.). The noted second state of the data storage media comprises storage in the storage media of data representing the electronic data signal from the CPU 42 (e.g., the wager in the present example). As another example, the CPU 42 further, in accord with the execution of the stored instructions relating to the wagering game, causes the primary display 18, other display device, or other output device (e.g., speakers, lights, communication device, etc.) to change from a first state to at least a second state, wherein the second state of the primary display comprises a visual representation of the physical player input (e.g., an acknowledgement to a player), information relating to the physical player input (e.g., an indication of the wager amount), a game sequence, an outcome of the game sequence, or any combination thereof, wherein the game sequence in accord with the present concepts comprises acts described herein. The aforementioned executing of the stored instructions relating to the wagering game is further conducted in accord with a random outcome (e.g., determined by the RNG) that is used by the game-logic circuitry 40 to determine the outcome of the wagering-game instance. In at least some aspects, the game-logic circuitry 40 is configured to determine an outcome of the wagering-game instance at least partially in response to the random parameter.

In one embodiment, the gaming machine 10 and, additionally or alternatively, the external system 60 (e.g., a gaming server), means gaming equipment that meets the hardware and software requirements for fairness, security, and predictability as established by at least one state's gaming control board or commission. Prior to commercial deployment, the gaming machine 10, the external system 60, or both and the casino wagering game played thereon may need to satisfy minimum technical standards and require regulatory approval from a gaming control board or commission (e.g., the Nevada Gaming Commission, Alderney Gambling Control Commission, National Indian Gaming Commission, etc.) charged with regulating casino and other types of gaming in a defined geographical area, such as a state. By way of non-limiting example, a gaming machine in Nevada means a device as set forth in NRS 463.0155, 463.0191, and all other relevant provisions of the Nevada Gaming Control Act, and the gaming machine cannot be deployed for play in Nevada unless it meets the minimum standards set forth in, for example, Technical Standards 1 and 2 and Regulations 5 and 14 issued pursuant to the Nevada Gaming Control Act. Additionally, the gaming machine and the casino wagering game must be approved by the commission pursuant to various provisions in Regulation 14. Comparable statutes, regulations, and technical standards exist in other gaming jurisdictions. As can be seen from the description herein, the gaming machine 10 may be implemented with hardware and software architectures, circuitry, and other special features that differentiate it from general-purpose computers (e.g., desktop PCs, laptops, and tablets).

Figure 4:
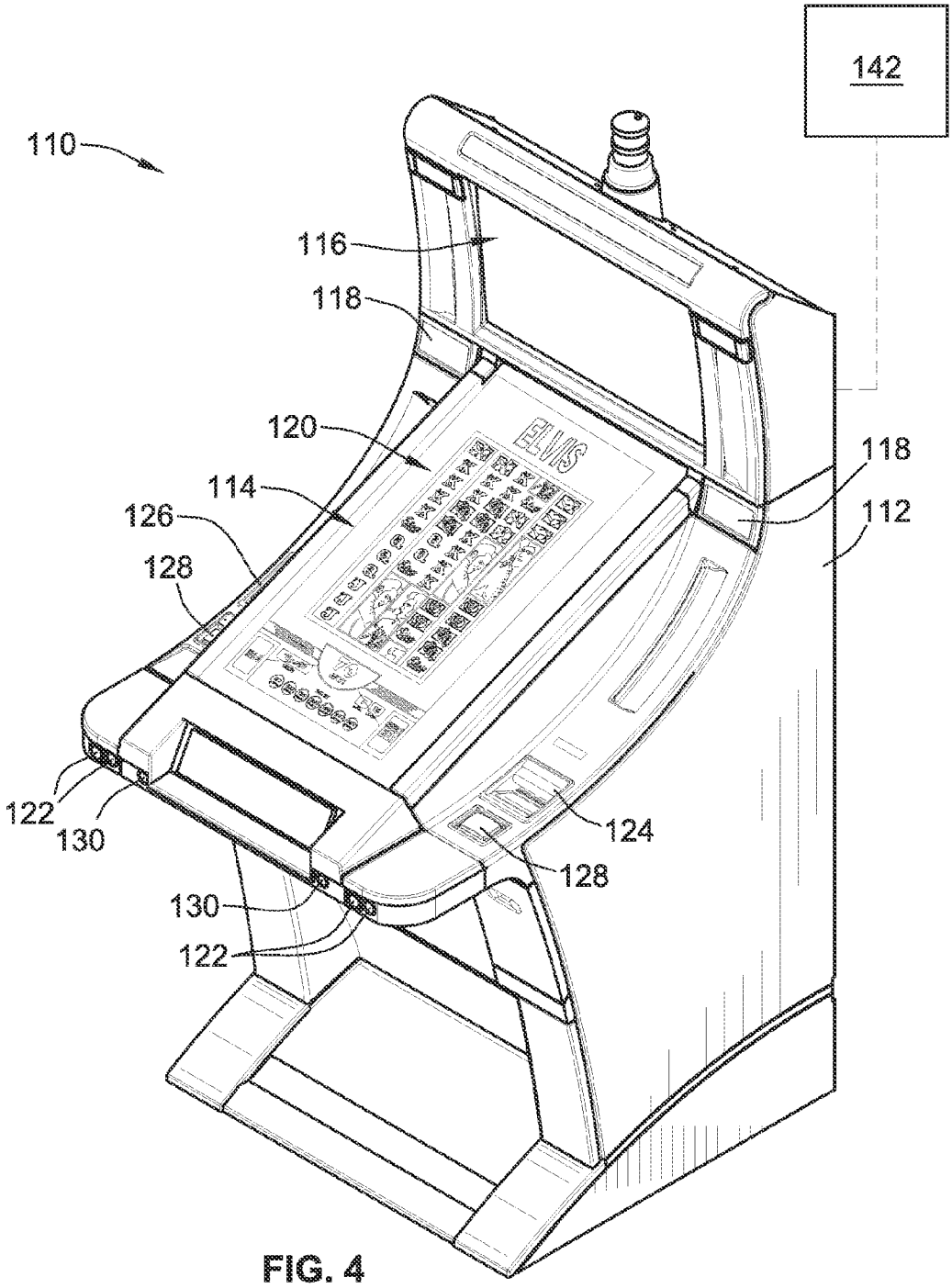
FIG. 4 is a perspective-view illustration of a representative gaming terminal for conducting an exemplary wagering game in accordance with aspects of the present disclosure.

Referring now to FIG. 4, a representative electronic gaming machine (EGM), designated generally at 110, for playing one or more casino wagering games is shown in accordance with aspects of the present disclosure. Although differing in appearance, the EGM 110 can be similar in function, operation, and connectivity to the gaming terminal 10 discussed above with respect to FIG. 1 and the gaming system discussed above with respect to FIG. 2 and, thus, can include any of the options, features and alternatives described with respect thereto. The electronic gaming machine 110 (also referred to herein as "casino gaming machine" or "slot machine") can take on various configurations including, for example, free standing gaming machines (as shown), handheld or portable gaming machines, countertop gaming machines, and the like. To that end, the electronic gaming machine 110 may be an electromechanical gaming terminal configured, for example, to play mechanical slots, or it may be an electronic gaming terminal configured, for example, to play a video casino game, such as keno, poker, slots, blackjack, roulette, etc. Markedly, the electronic gaming machine 110 of FIG. 4 is purely representative in nature, and presented solely for explanatory purposes. As such, all aspects of the present invention are in no way limited to the terminal configuration shown in the drawings.

Gaming machine 110 comprises a secured gaming cabinet 112 for housing a variety of operational componentry (e.g., game-logic circuitry 40, external systems interface 58, etc.). For output devices, the electronic gaming machine 110 includes a primary display area (or "first electronic display device") 114, secondary display area (or "second electronic display device") 116, and one or more audio speakers 118. Primary display area 114 and/or secondary display area 14 may be a mechanical-reel display, a video display, or a combination thereof in which, for example, a transmissive video display may be disposed in front of electro-mechanical-reels to portray a video image superimposed upon the reels. Recognizably, one or more of the foregoing display areas/devices can be combined into a single display area/device or separated into three or more display areas/devices. For input devices, the electronic gaming machine 110 may include a touch screen 120 mounted over the primary and/or secondary areas 114, 116, push buttons 122, bill validator 124, information reader/writer(s) 126, quick-play buttons 128 and player-accessible port(s) 130 (e.g., audio output jack for headphones, video headset jack, USB port, wireless transmitter/receiver, etc.). While these typical components found in the electronic gaming machine 110 are described above, it should be understood that numerous additional/alternative peripheral devices and other elements may exist and may be used in any number of combinations to create various forms of a gaming terminal.

Similar to embodiments presented above in FIGS. 1 and 2, the EGM 110 of FIG. 4 may communicate with an external system (e.g., external system(s) 60 of FIG. 2) such that the terminal operates as a "thin client," a "thick client," or through any range of functionality therebetween. By way of example, a casino gaming system (CGS) controller is schematically illustrated at 142 in FIG. 4 operatively connected to the electronic gaming machine 110 such that the gaming machine 110 can access and engage in external game-related and non-game related features, such as a shared game, a community game, a local area progressive (LAP) game, a wide area progressive (WAP) game, etc. The CGS controller 142 may be similarly configured in accordance with any of the optional configurations and features described above with respect to the CPU 42 of FIG. 2. For some optional embodiments, the CGS controller 142 takes on the form of a central server or server system, a central controller, a dedicated progressive jackpot controller, and/or a remote host that links to the electronic gaming machine 110 through a data network or remote communication link 144. To that end, the game-logic circuitry of the electronic gaming machine 110 can be designed to transmit and receive events, messages, commands, and/or any other suitable data or signals to and from the controller 142. In combination, the electronic gaming machine 110 and CGS controller 142 can be considered a gaming system 100 or part of a gaming system 100.

Figure 5:
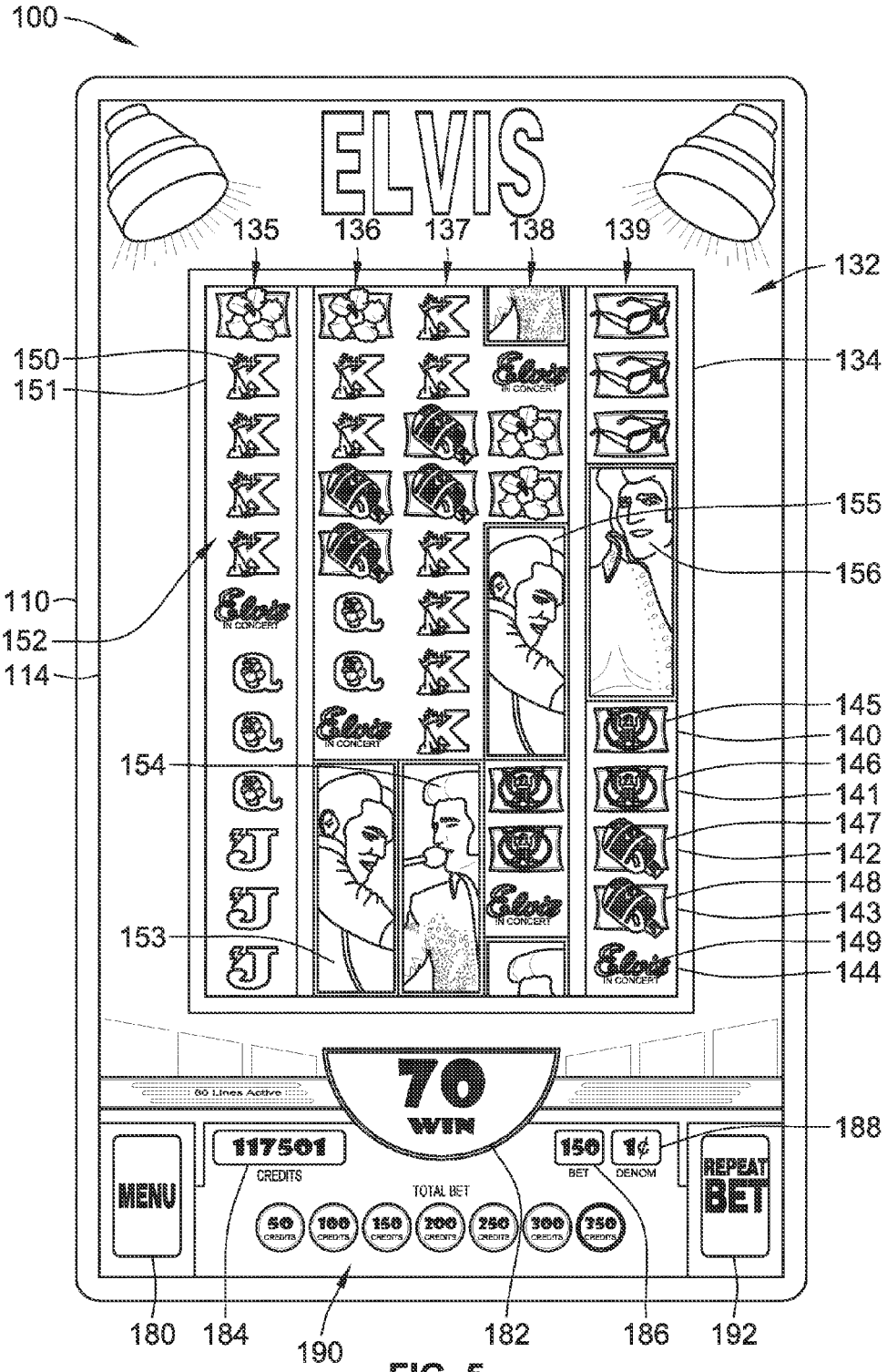
FIG. 5 is a screen shot of an example of a basic game from the representative wagering game of FIG. 4.

FIG. 5 is a screen shot of a game screen from an exemplary wagering game in accordance with aspects of the present disclosure. Display device 114 displays or otherwise visually depicts a wagering game 132, which in this example is the slot game shown in FIG. 5. The slot game 132 includes a base-game segment comprising a plurality of symbol-bearing reels, represented herein by five simulated slot reels 135-139, each with a sequence of distinct reel positions (collectively represented by reel positions 140-144 in FIG. 5) occupied by a variety of different symbols (collectively represented by symbols 145-149 in FIG. 5). The symbols may include any variety of graphical symbols, emblems, elements, or representations, including symbols that are associated with one or more themes (e.g., an ELVIS® theme) of the gaming machine 110 or the gaming system 100. The reel symbols may also include a blank symbol or empty space.

Select symbols on each of the reels 135-139 are arranged in an array 134, which in this embodiment is a rectangular 12×5 matrix—twelve rows by five columns—of distinct array positions displayed via the display device 114 (60 total array positions in FIG. 5). Unlike a reel position, an array position is typically not borne by, nor movable with, a symbol-bearing reel. The reels 135-139 are varied (e.g., spun and stopped) to reveal combinations of symbols, which represent randomly selected outcomes of the wagering game 132, that are evaluated against predetermined award criterion. Winning combinations of symbols landing, for example, on activated paylines (e.g., those paylines for which a wager has been received), cause awards to be paid in accordance with one or more pay tables associated with the gaming machine 110. In some embodiments, winning combinations of symbols include three or more like symbols aligned adjacent one another on an active pay line (e.g., left-to-right configuration, right-to-left configuration, or both). In some embodiments, symbol combinations are evaluated in accord with various other schemes such as, but not limited to, scatter pays.

The casino wagering game 132 can include greater or fewer symbol-bearing reels (simulated, mechanical, or otherwise), each of which may include greater or fewer symbols than that shown in FIGS. 4 and 5. In the same vein, the randomly selected outcomes of the base game may comprise greater or fewer than 15 symbols, and may take on a variety of different forms having greater or fewer rows and/or columns. The matrix may even comprise other non-rectangular forms or arrangements of symbols. Moreover, the randomly selected outcomes of the wagering game 132 may be varied from the representation provided in FIGS. 4 and 5. Likewise, the ELVIS® theme is purely illustrative and non-limiting in nature.

Primary display 114 presents certain display features for providing information and options to a player. For example, the display 114 features may include a MENU/HELP button 180, a WIN meter 182, a CREDITS meter 184, and a BET meter 186. The MENU button 180 can be pressed and activated (e.g., through an overlying touch screen) by a player desiring to access other control menus, preferences, help screens, etc. For example, the player can change a theme of the wagering game 130 via the MENU button 180, or change the type of wagering game being played (e.g., to video poker, keno, etc.). The WIN meter 182 displays to the player the amount of the total win (if any) from the most recent play of the wagering game 130. The CREDITS meter 184 displays to the player the total amount of credits (if any) remaining and available to the player for play of the wagering game 130. The BET meter 186 displays to a player the current size of his/her wager (in credits). Fewer, additional or alternative display features may be included for presenting information/selectable options to a player. The primary display 114 can also include, for example, an optional change DENOM button 188 that can be activated to change the denomination of wagers (e.g., from $0.25 minimum wager to $1.00 minimum wager) which the player is inputting into the system 100. A row of player-selectable bet-per-payline CREDIT buttons 190 permits a player to quickly select from an assortment of preset bet per active payline wager values. Optionally, a REPEAT BET button 192 may be provided for automatically wagering the same number of credits wagered in the previously play of the wagering game and contemporaneously spinning the reels of the wagering game 132.

Some of the symbols in the wagering game 132 can be grouped into a corresponding clump of symbols. The term "clump" or "symbol clump" refers to one or more of a single type of symbol occupying two or more reel positions that are located immediately adjacent one another on a single reel. By way of example, and not limitation, a "standard" symbol clump can consist of multiple identical symbols grouped together to occupy multiple immediately adjacent reel positions on a single reel. One non-limiting example can be seen on the first reel 135 in FIG. 5, which has a symbol clump designated generally at 152 that comprises four king K symbols, one of which is designated as 150 in the drawings, occupying four immediately adjacent reel positions, one of which is designated as 151, on the reel 135. Alternatively, a "picture" symbol clump can consist of a single, elongated symbol that occupies multiple immediately adjacent reel positions on a single reel. Non-limiting examples of picture-type symbol clumps can be found at 153 on the second reel 136, at 154 on the third reel 137, at 155 on the fourth reel 138, and at 156 on the fifth reel 139 of FIG. 5. Clump 153, for instance, consists of a single ELVIS LIVE symbol that occupies four immediately adjacent reel positions on the second reel 136. Comparatively, clump 154 consists of a single ELVIS SINGS symbol that occupies four immediately adjacent reel positions on the third reel 137. In yet a further optional arrangement, a clump may comprise one or more picture clumps in combination with one or more corresponding standard-sized symbols that occupy numerous reel positions that are all immediately adjacent one another on a single reel. In at least some embodiments, each array position filled by a portion of a symbol clump is evaluated in the same manner as if a single symbol of that type were occupying that position. However, by filling multiple adjacent reel positions with one or more of the same symbols, a clump typically increases the likelihood of achieving a particular winning outcome and corresponding award for that symbol type.

Figure 7:
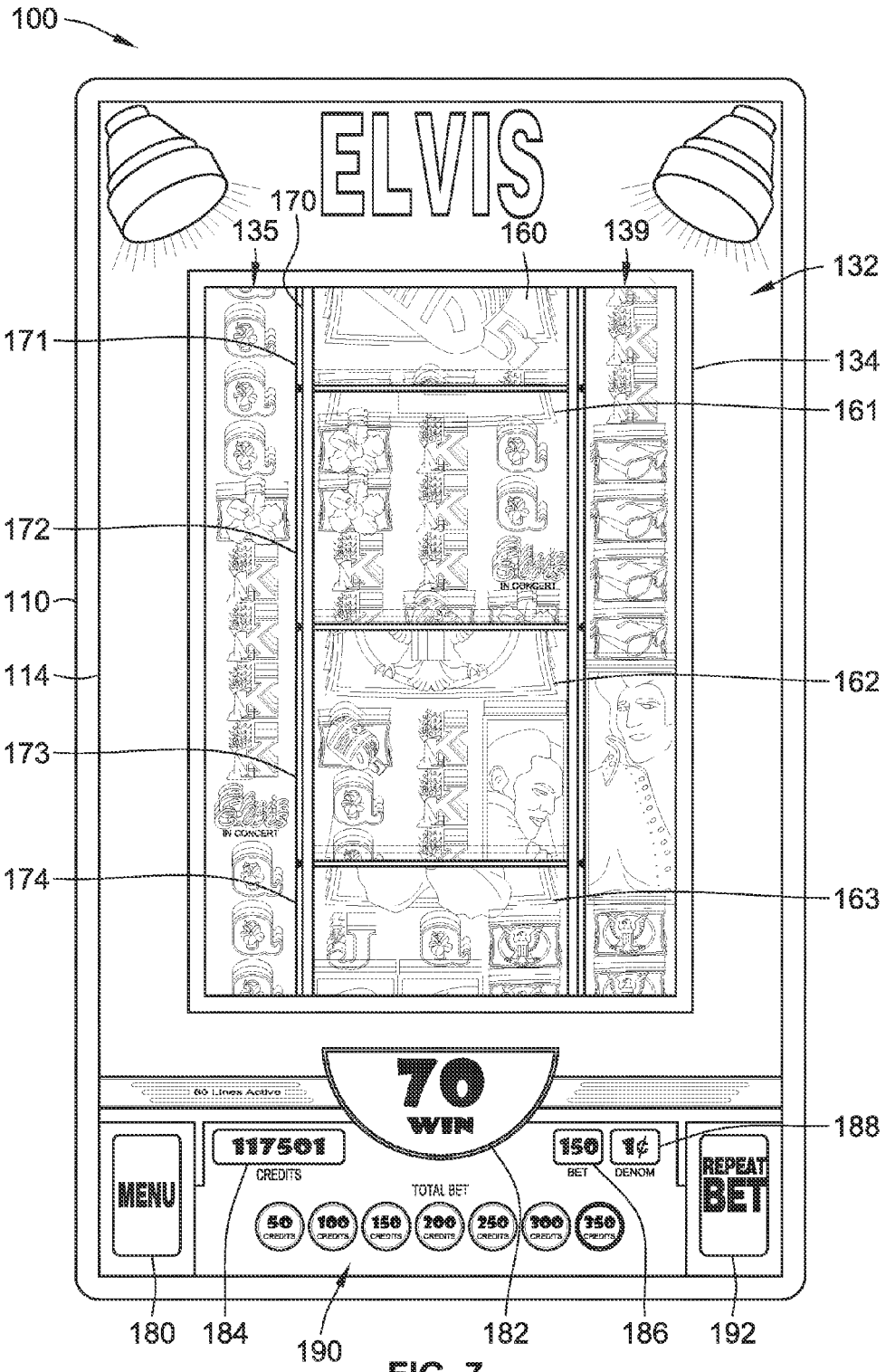
FIG. 7 is a screen shot illustrating multiple standard-sized reels of the representative basic game of FIG. 5 transforming into an expanded multi-reel carriage which carries plural non-standard-sized mega-symbol-bearing reels.
Figure 8:
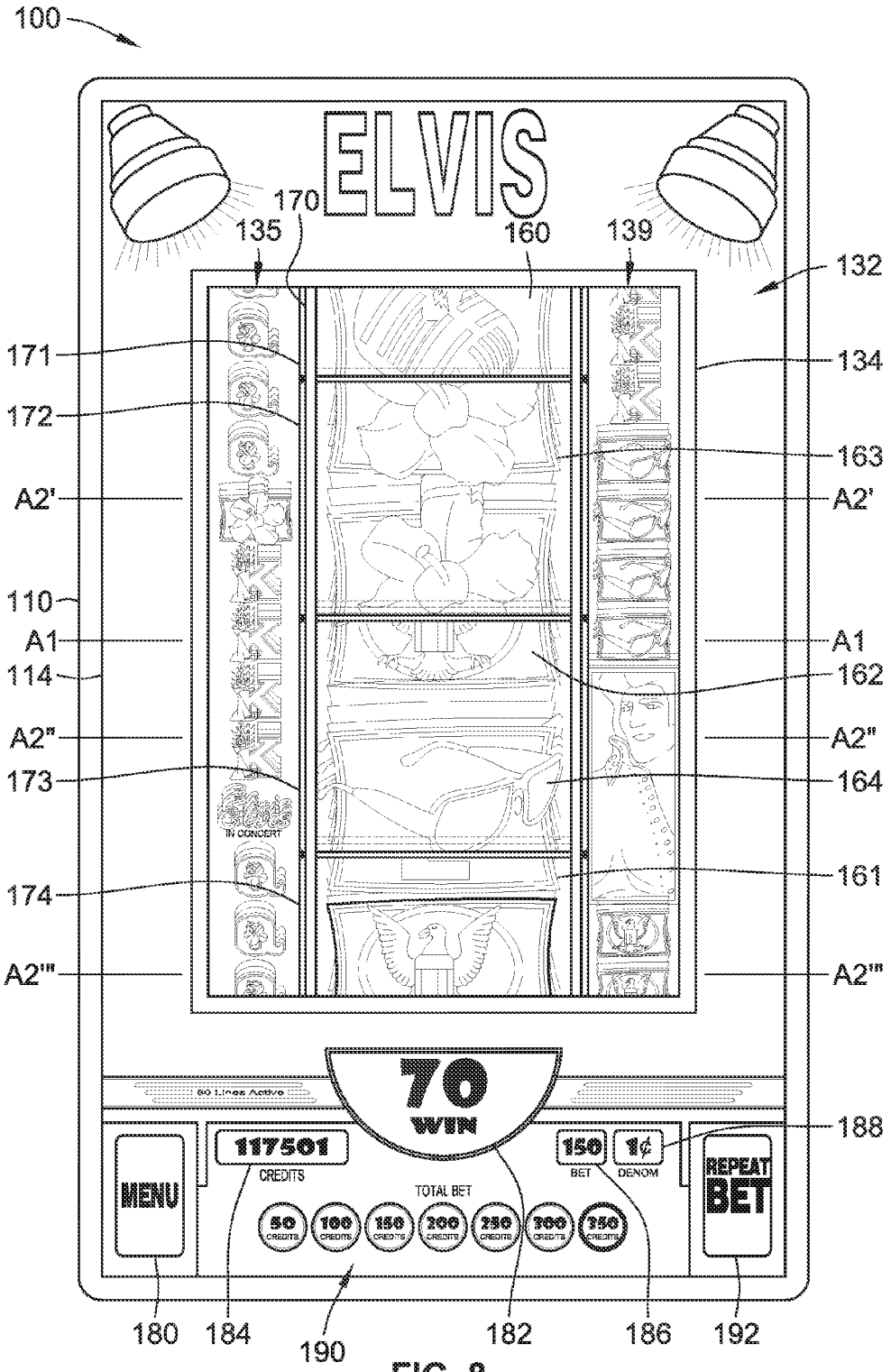
FIG. 8 is a screen shot of an example of a mega-symbol game segment from the representative wagering game of FIG. 4 illustrating the standard-sized reels and expanded multi-reel carriage spinning while each of the non-standard-sized reels spins.

In contrast to the "standard-sized" symbols 145-149, each of which occupies a single reel position and operates to populate a single array position, and "clumped" symbols 152-156, each of which occupies multiple reel positions of a single reel and operates to populate multiple array positions of a single array column, a mega symbol (e.g., mega symbols 160-164 of FIGS. 7 and 8) is a single, enlarged symbol that operates to populate multiple vertically and laterally adjacent array positions of the array 134. Put another way, a mega symbol is widened and extended to populate at least two adjacent array positions in each of at least two neighboring array columns when displayed in the array 134. For at least some embodiments, a mega symbol has a minimum size of two-by-two array positions. By way of non-limiting example, microphone mega symbol 160 is shown in FIG. 8 as a single symbol that is configured to occupy four consecutive array positions in each of three neighboring columns of the array 134 (e.g., a 4×3 block of array positions). It should be readily appreciated that a mega symbol can take on other shapes (e.g., square, diamond, triangle, etc.), other sizes (e.g., sizes ranging from two-by-two array positions to the size of the entire array 134), and/or other locations within the array 134 than those illustrated in the Figures. Mega symbols may take on other forms, both symmetrical and asymmetrical as well, such as a mega symbol stretching four array columns and having a height of one array position in the first column, a height of two array positions in the second column, three in the third column, and two in the fourth column.

Figure 6:
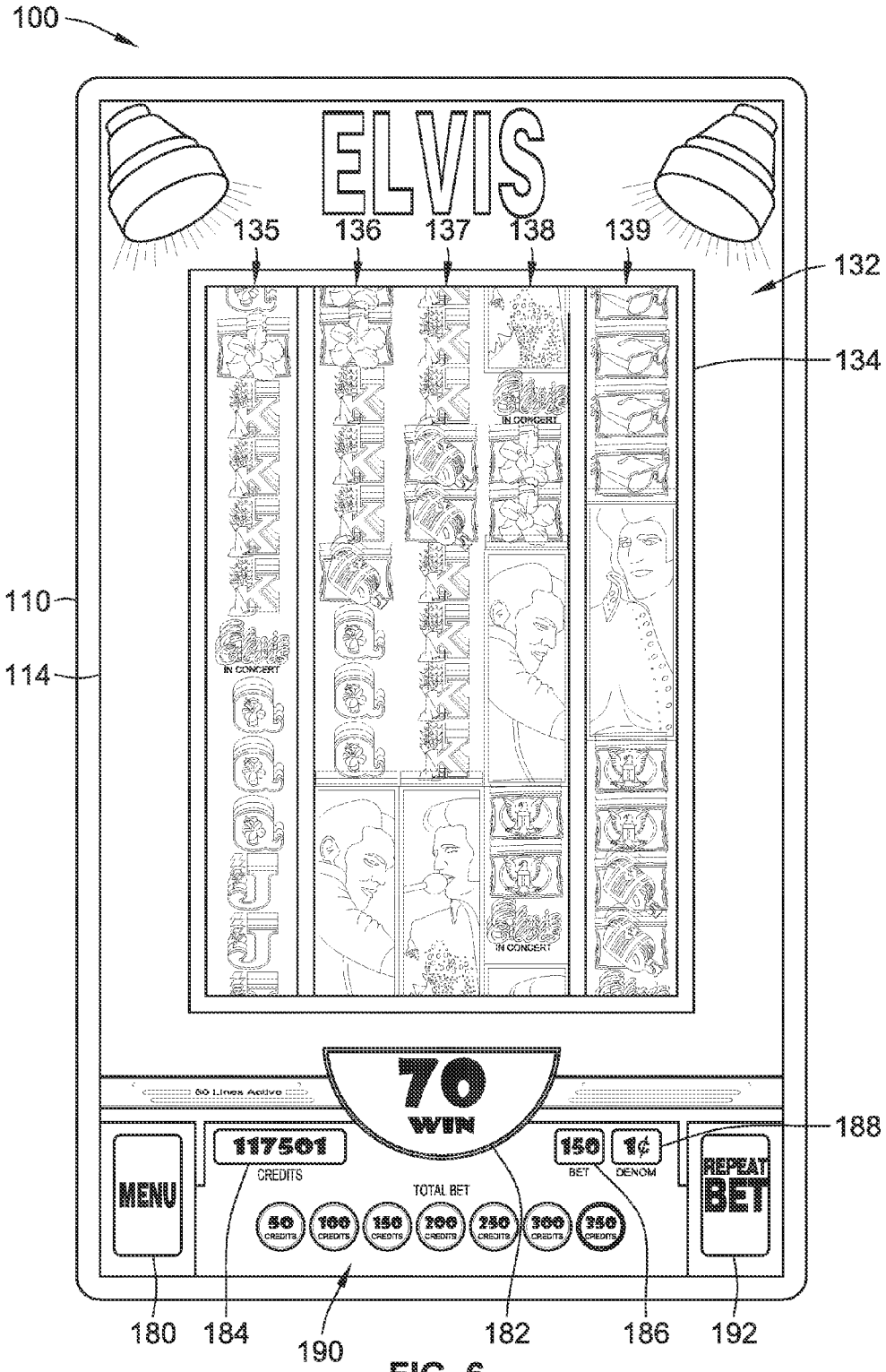
FIG. 6 is a screen shot of the basic game of FIG. 5 illustrating the standard-sized reels spinning to subsequently reveal a randomly determined outcome of the base-game segment of the representative wagering game of FIG. 4.

The wagering game 132 is shown in FIG. 6 after play of a base game segment is initiated, for example, responsive to a player providing a wager (e.g., a first physical input via a first input device), and thereafter pressing a spin button or pulling a spin lever (e.g., a second physical input via a second input device). The monetary wager, which is typically a selected number of credits, is deducted from the available credits, e.g., the 117, 501 credits displayed via the CREDITS meter 184 in FIG. 6. The monetary wager that is in play (e.g., 150 credits in FIG. 6) can be displayed via the BET meter 186. The reels 135-139 may then be varied (e.g., spun and stopped); reels 135-139 continue to spin until they are stopped to reveal in the displayed array 134 reel symbols which represent a randomly selected outcome of the wagering game 132. The wagering-game outcome is, according to some aspects, randomly determined from a plurality of available wagering-game outcomes. As indicated above, each outcome is evaluated for compliance with one or more predetermined award criterion to determine if the displayed outcome has one or more awards associated therewith.

Figure 10:
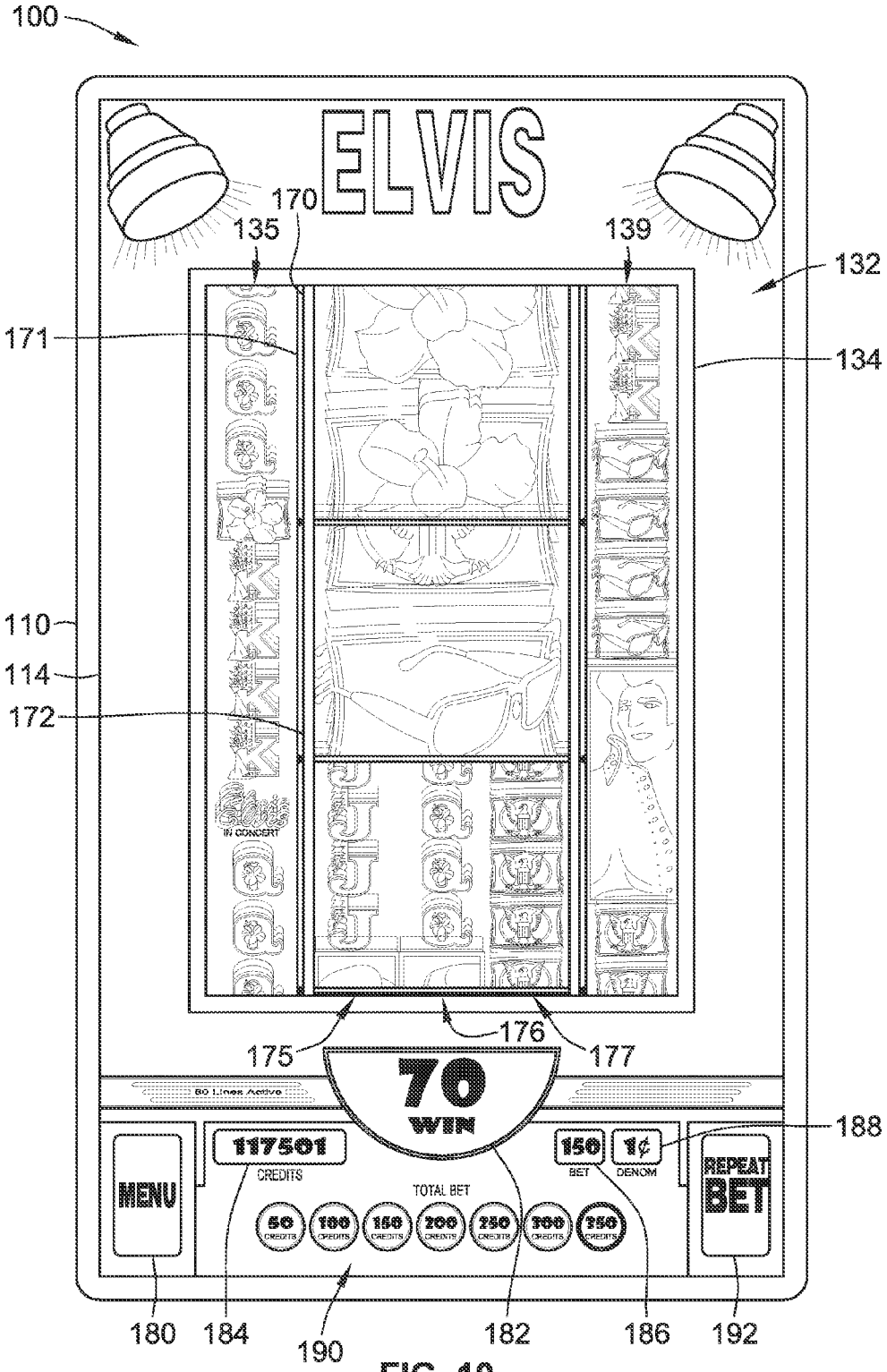
FIG. 10 is a screen shot of another representative mega-symbol game from the representative wagering game of FIG. 4 illustrating an expanded multi-reel carriage that carries multiple individually spinnable mega-symbol-bearing "king" reels and multiple individually spinnable "mini" reels.

Prior to, contemporaneous with, or after the reels have been varied, at least one of the standard-sized reels 135-139 is changed into a multi-reel carriage that carries a plurality of non-standard-sized symbol-bearing reels. In general, a "standard-sized" symbol-bearing reel (also referred to herein as "standard reel") is dedicated to a single one of the columns of the array 132 and operates to populate every array position in that column. The first reel 135, for instance, spins and stops to populate the 12 distinct array positions in the first column of the array 134. Conversely, a "non-standard-sized" symbol-bearing reel operates to populate only a subset of the array positions in a single column of the array 132, is not limited to a single column of the array 132, or both. One example of a non-standard-sized reel is a miniature symbol-bearing reel (or "mini reel"). FIG. 10 illustrates three mini reels 175-177, each with a sequence of distinct reel positions occupied by a variety of different symbols. Each miniature symbol-bearing reel 175-177 is dedicated to and is operable to populate only a subsection of a single one of the columns of the array 134. The first mini reel 175 of FIG. 10, for instance, spins and stops to populate only four distinct array positions in the second column of the array 134. The remaining array positions in the second column are populated by other non-standard-sized reels.

A second example of a non-standard sized reel is a mega-symbol-bearing "king" reel. FIG. 8 illustrates four mega-symbol-bearing reels 171-174, each with a sequence of distinct reel positions occupied by a variety of mega symbols, such as mega symbols 160-164. Each of the illustrated mega-symbol-bearing reels 171-174 is operable to occupy multiple vertically adjacent array positions and multiple laterally adjacent array positions in neighboring rows and columns of the array 134. Similar to a mega symbol, for example, these king reels 171-174 are widened and extended to populate at least two adjacent array positions in each of at least two neighboring array columns when displayed in the array 134 (e.g., a 4×3 block of array positions). As shown, the symbols borne by a mega-symbol-bearing reel are limited to only mega symbols; alternatively, a mega-symbol-bearing reel may also comprise standard-sized symbols, picture clumps, and other known symbol types and sizes. While only four mega-symbol-bearing reels 171-174 are visible in FIG. 8, the multi-reel carriage 170 of the displayed embodiment carries numerous additional non-standard-sized reels, whether king or mini, that are not otherwise visible with the current orientation of the carriage. For other embodiments, the multi-reel carriage 170 may carry fewer than four non-standard-sized symbol-bearing reels. It is also envisioned that one or more of the non-standard-sized reels take on the form of a miniaturized multi-reel carriage.

In some embodiments, a single standard-sized reel transforms into or is replaced with a multi-reel carriage during play of the wagering game 134. Optionally, according to the representative example illustrated in FIG. 7, multiple neighboring ones of the standard-sized reels, namely the second, third and fourth reels 136-138, transform into a single, laterally expanded multi-reel carriage 170. As seen in the sequential progression of the wagering game 134 illustrated in FIGS. 6-8, the changing of the standard-sized reel(s) into the multi-reel carriage 170 includes progressively transforming the reel(s) into the carriage while all of the standard-sized reels and multi-reel carriage are spinning. Alternative configurations are also envisioned, including replacing the standard-sized reel(s) with the multi-reel carriage 170 prior to or after spinning of the reel(s), i.e., when the standard-sized reels and/or carriage are stationary. This transformation/replacement may take place systematically or randomly, for example, on any given play of the wagering game.

Comparable in construction to a Ferris wheel (also known as "observation wheels"), the multi-reel carriage 170 may comprise an annular or capped rim that is rotatably mounted via a central hub or roller bearing onto a wheel tower or other support structure. In a similar regard, each of the non-standard-sized reels, whether it be mega-symbol-bearing reels 171-174 or mini reels 175-177 or combinations thereof, may comprise its own rim structure that is rotatably mounted via a hub or roller bearing onto the multi-reel carriage 170. Non-standard-sized reels, in at least some configurations, are equidistantly spaced along the outer circumference of the rim. In so doing, these non-standard-sized reels can be driven, either at similar or differing rotational speeds, independently of each other and independently of the carriage. As indicated above, all of the reels presented by the primary display device 114, including the multi-reel carriage 170, can be video-simulated replications of a corresponding electro-mechanical counterpart. In some embodiments, the multi-reel carriage 170 occupies only a single column of the array 134 while, as shown, the expanded multi-reel carriage 170 occupies multiple neighboring ones of the columns of the array, namely the three central columns of the five column array 134. Optionally, one of the end reels—e.g., the first and/or fifth standard-sized reels 135, 139—can change into an expanded multi-reel carriage and thereby expand the size of the array 134 by one or more columns of distinct array positions.

Once the transformation is complete, the electronic display device 114 displays each of the non-standard-sized reels 171-174 spinning individually and contemporaneously with the spinning of the remaining standard-sized reels 135, 139 and the spinning of the multi-reel carriage 170, as illustrated in FIG. 8. Alternative embodiments may comprise spinning the non-standard-sized reels 171-174 and the multi-reel carriage 170, either individually or as a group, at distinct times from the standard-sized reels 135, 139 (e.g., while one or both of the reels 135, 139 are stopped). As indicated above, the standard-sized reels 135, 139, non-standard-sized reels 171-174, and multi-reel carriage 170 can spin at the same speed or at distinct speeds. In the illustrated example, the standard-sized reels 135-139 and multi-reel carriage 170 are coaxially mounted to rotate about a common (first) central axis A1 that extends transversely with respect to the array 134. The non-standard-sized reels 171-174, by way of contrast, are each mounted to the multi-reel carriage 170 to rotate about a respective axis (three distinct (second) axes A2', A2" and A2"' are presented as examples in FIG. 8) that is distinct from the common central axis A1-A1. Each said second axis A2', A2", A2"' is generally parallel to and radially spaced from the common central axis A1.

Figure 9:
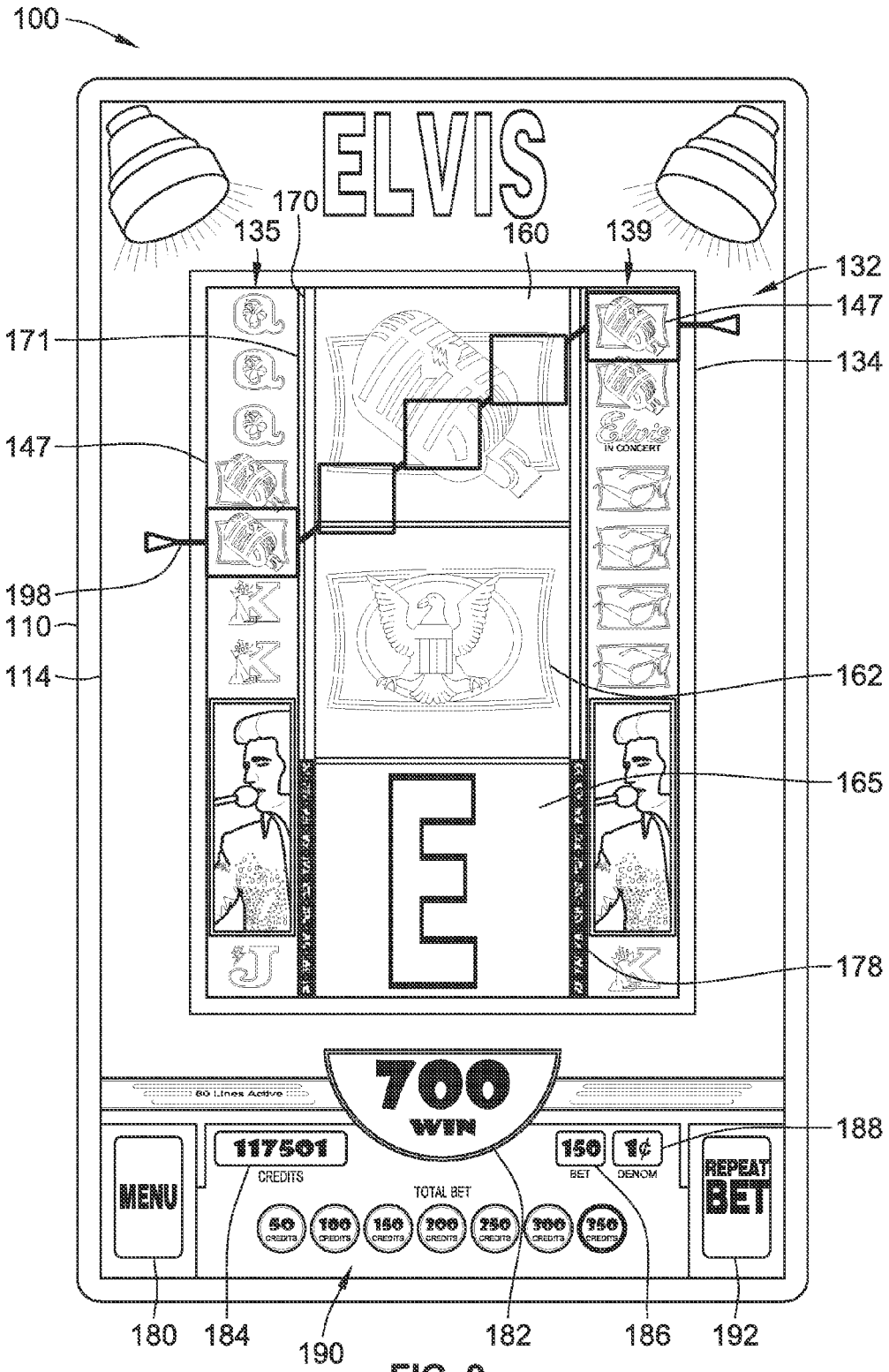
FIG. 9 is a screen shot of the representative mega-symbol game of FIG. 8 illustrating the standard-sized reels and non-standard-sized reels stopping to populate the symbol array with symbols as part of the final game outcome.

An example of a randomly determined outcome of a MEGA ELVIS segment of the casino wagering game 134 is presented in FIG. 9. Electronic display device 114 is shown in FIG. 9 displaying the standard-sized reels 135, 139, non-standard-sized reels 171-174, and carriage 170 stopping to populate the array 134 with symbols and thereby reveal to a player the randomly determined outcome. The reels and carriage may be stopped in unison for some configurations whereas, for other configurations, each of the standard-sized reels 135, 139, non-standard-sized reels 171-174 and carriage 170 can be stopped sequentially, non-sequentially or in a random order after a lapse of some predetermined time. The outcome includes symbols borne by the standard-sized reels 135, 139 and symbols borne by the non-standard-sized reels 171-174 populating the distinct array positions arranged in the array 134. Prior to, contemporaneous with, or after stopping the reels, the randomly determined game outcome—i.e., the symbols populating the array 134—is evaluated to determine if the game outcome meets at least one predetermined award criterion. By way of non-limiting example, paylines traversing, for example, left-to-right across the reels are used to evaluate each outcome for winning symbol combinations. In FIG. 9, an active payline 196, which extends from the left-hand side of the array 134, through the first standard-sized reel 135, across the top-most non-standard-sized reel 171, and through the fifth standard-sized reel 139 to the right-hand side of the array 134, highlights a winning symbol combination comprising five sequentially aligned microphone symbols. Two of the five microphone symbols in the winning symbol combination are provided by the first and fifth standard-sized reels 135, 139, while three of said microphone symbols are provided by a microphone mega symbol 160 on the mega-symbol-bearing reel 171. Additional methods of evaluation, including those discussed above, may be employed when the non-standard-sized reels are triggered, including vertical evaluations, scatter evaluations, right-to-left evaluations, etc.

In at least some embodiments, the expanded multi-reel carriage 170 and the non-standard-sized reels 171-174 are indexed such that each and every mega symbol 160-164 of the mega-symbol-bearing reels 171-174, when part of a wagering-game outcome, can only land completely flush (i.e., in its entirety) in the array 134. As a non-limiting example, weighted probabilities assigned to the reel positions of each mega-symbol-bearing reel are configured such that a mega symbol, when part of one of the wagering-game outcomes, can only land in its entirety in the array. The embodiment illustrated in FIG. 9, for example, portrays each of the three 4×3 mega symbols 160, 162 and 165 landing completely flush in the array when the carriage 170 and reels 171-174 stop. Optional variations will allow one or some or all of the mega symbols to land with only a subsection thereof populating the array 134 as part of a game outcome. Another optional game feature includes a bonus-game-triggering mega symbol 165 which operates to trigger a bonus game segment of the wagering game 132 when said bonus-game-triggering mega symbol 165 lands in its entirety at a predetermined location of the array 134, which may be highlighted by a bonus trigger frame 178 for ease of identification by the player.

FIG. 10 illustrates another representative mega-symbol game segment from the representative wagering game 134 of FIG. 4. In this example, an expanded multi-reel carriage 170 carries multiple individually spinnable mega-symbol-bearing "king" reels, two of which are visible at 171 and 172 in FIG. 10, and multiple individually spinnable "mini" reels, three of which are visible at 175-177 in FIG. 10. As indicated above, each of the miniature symbol-bearing reels 175-177 is operable to populate a subsection of a single one of the columns of the array 134. The first mini reel 175, for instance, spins and stops to populate four distinct array positions in the second column of the array 134, while the second mini reel 176 is configured to populate four distinct array positions in the third column of the array 134, and the third mini reel 177 is configured to populate four distinct array positions in the fourth column of the array 134.

Figure 11:
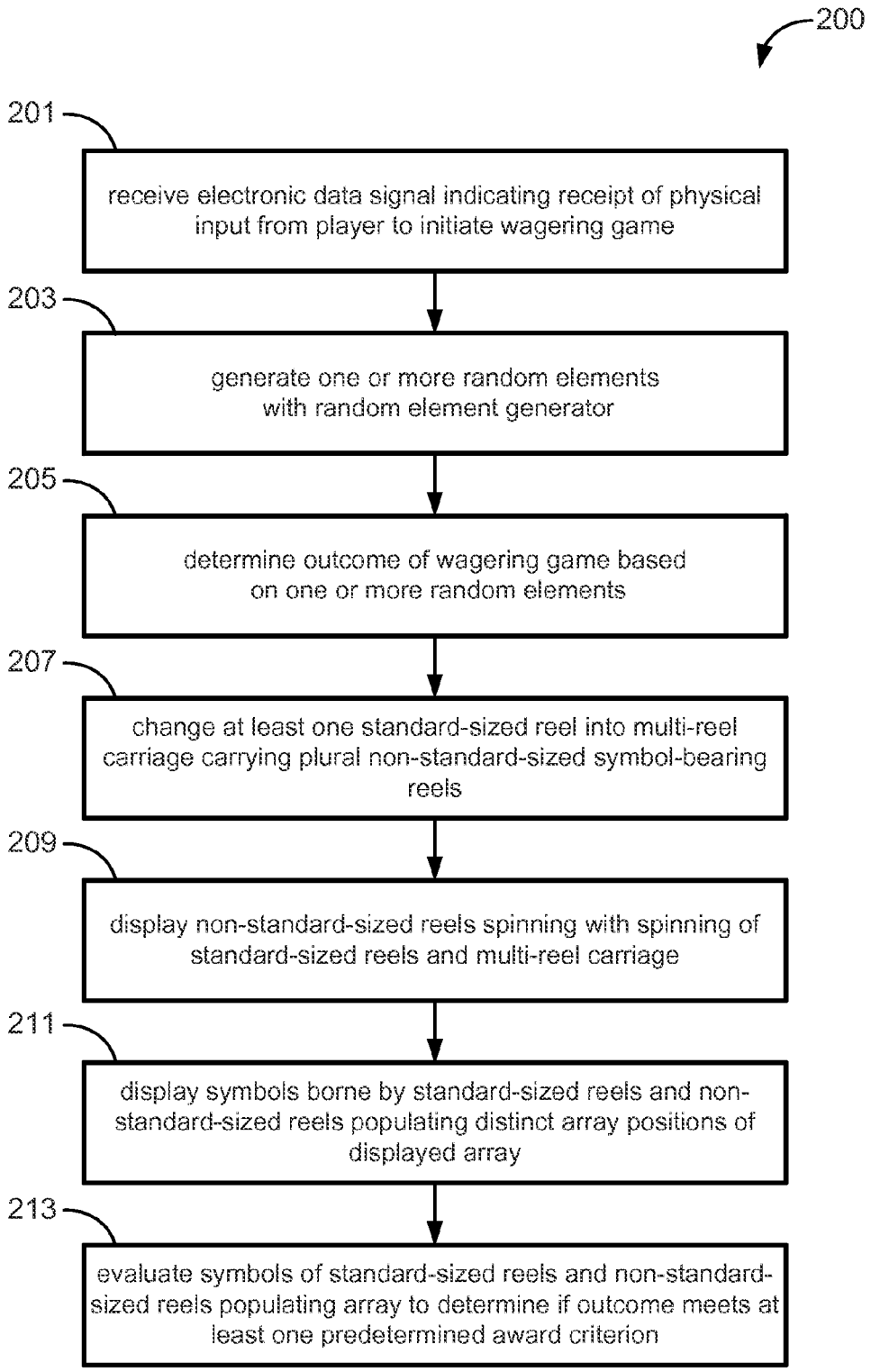
FIG. 11 is a flowchart for an algorithm that corresponds to instructions executed by game-logic circuitry of a gaming system or an electronic gaming machine in accord with aspects of the disclosed concepts.

With reference now to the flow chart of FIG. 11, an improved method for conducting a slot-type casino wagering game on a gaming terminal and/or a gaming system primarily dedicated to conducting casino wagering games, such as those shown in FIGS. 1, 2 and 4, for example, is generally described at 200 in accordance with aspects of the present disclosure. FIG. 11 can be representative of an algorithm that corresponds to at least some instructions that can be stored, for example, in main memory 32 of FIG. 2, and executed, for example, by the CPU 30 and/or external system(s) 48 of FIG. 2 to perform any or all of the above or below described functions associated with the disclosed concepts. The method 200 will be described with reference to the various aspects and features shown in FIGS. 4-10 of the drawings; such reference is being provided purely by way of explanation and clarification.

The method 200 starts at block 201 by receiving an indication of a wager to initiate play of a wagering game, such as slot game 132 of FIG. 5. This may comprise a physical input from the player being received via an input device, such as touch screen 24, bill/ticket acceptor 28, card reader/writer 30, etc. The player-input device(s) then transforms the player input(s) to electronic data signal(s) indicative of the player input(s). Responsive to the electronic data signal or signals received from the one or more electronic player-input devices, block 203 includes generating one or more random elements with a random element generator (e.g., a random number generator (RNG) stored in a main memory and executed by a CPU). At block 205, an outcome of a base-game segment of the wagering game is randomly determined. This may include, as indicated above, an RNG generating a random number, game logic 40 for determining the outcome based on the randomly generated number, and the CPU 30, the external system 48, or both, in alternative embodiments, operating to execute a wagering game program, and game assets (e.g., art, sound, etc.) for presenting the determined outcome to a player in a visual manner. The base-game outcome of the wagering game is visually represented to the player by a plurality of symbols arranged in an array on a display device, such as the symbol array 134 of FIG. 5.

In response to a triggering event during play of the casino wagering game, block 207 of method 200 changes at least one standard-sized reel of the slot game (e.g., one or more or all of the standard-sized symbol-bearing reels 135-139 of FIG. 5) into a multi-reel carriage, such as multi-reel carriage 170. Unlike the reel carriages of the standard-sized reels, which typically support a single, stationary reel strip, a multi-reel carriage is configured to carry plural non-standard-sized symbol-bearing reels, each of which is rotatably mounted onto the carriage. Various examples of non-standard-sized reels are depicted in FIGS. 7-10 of the drawings, such as king reels 171-174 and mini reels 175-177. At block 209, one or more electronic display devices display the non-standard-sized reels spinning with the standard-sized reels and the multi-reel carriage. As explained above, each of the non-standard-sized reels 171-174 can be displayed spinning individually and contemporaneously with the spinning of the remaining standard-sized reels 135, 139 and the spinning of the multi-reel carriage 170.

Continuing to block 211, the method 200 requires displaying the randomly determined outcome of the casino wagering game on one or more of the display devices, such as primary display device 114. According to the illustrated embodiment, the outcome includes symbols borne by the standard-sized reels and non-standard-sized reels populating the distinct array positions arranged in an array on the display device. FIG. 9, for example, illustrates the standard-sized reels 135, 139, non-standard-sized reels 171-174, and carriage 170 stopping to populate the array 134 with symbols and thereby reveal to a player the randomly determined outcome. At block 213, game-logic circuitry evaluates the symbols of the standard-sized reels and non-standard-sized reels populating the array to determine if the outcome of the casino wagering game meets at least one predetermined award criterion. This evaluation may be conducted in any manner described herein or otherwise known.

In some embodiments, the method 200 includes at least those steps enumerated above. It is also within the scope and spirit of the present disclosure to omit steps, include additional steps, and/or modify the order presented above. It should be further noted that the method 200 represents a single play of a wagering game. However, it is expected that the method 200 be applied in a systematic and repetitive manner.

Aspects of this disclosure can be implemented, in some embodiments, through a computer-executable program of instructions, such as program modules, generally referred to as software applications or application programs executed by a computer. The software can include, in non-limiting examples, routines, programs, objects, components, and data structures that perform particular tasks or implement particular abstract data types. The software can form an interface to allow a computer to react according to a source of input. The software can also cooperate with other code segments to initiate a variety of tasks in response to data received in conjunction with the source of the received data. The software can be stored on any of a variety of memory media, such as CD-ROM, magnetic disk, bubble memory, and semiconductor memory (e.g., various types of RAM or ROM).

Moreover, aspects of the present disclosure can be practiced with a variety of computer-system and computer-network configurations, including hand-held devices, multiprocessor systems, microprocessor-based or programmable-consumer electronics, minicomputers, mainframe computers, and the like. In addition, aspects of the present disclosure can be practiced in distributed-computing environments where tasks are performed by remote-processing devices that are linked through a communications network. In a distributed-computing environment, program modules can be located in both local and remote computer-storage media including memory storage devices. Aspects of the present disclosure can therefore, be implemented in connection with various hardware, software or a combination thereof, in a computer system or other processing system.

Any of the methods described herein can include machine readable instructions for execution by: (a) a processor, (b) a controller, and/or (c) any other suitable processing device. Any algorithm, software, or method disclosed herein can be embodied in software stored on a tangible medium such as, for example, a flash memory, a CD-ROM, a floppy disk, a hard drive, a digital versatile disk (DVD), or other memory devices, but persons of ordinary skill in the art will readily appreciate that the entire algorithm and/or parts thereof could alternatively be executed by a device other than a controller and/or embodied in firmware or dedicated hardware in a well-known manner (e.g., it can be implemented by an application specific integrated circuit (ASIC), a programmable logic device (PLD), a field programmable logic device (FPLD), discrete logic, etc.). Also, some or all of the machine readable instructions represented in any flowchart depicted herein can be implemented manually. Further, although specific algorithms are described with reference to flowcharts depicted herein, persons of ordinary skill in the art will readily appreciate that many other methods of implementing the example machine readable instructions can alternatively be used. For example, the order of execution of the blocks can be changed, and/or some of the blocks described can be changed, eliminated, or combined.

It should be noted that the algorithms illustrated and discussed herein as having various modules or blocks or steps that perform particular functions and interact with one another are provided purely for the sake of illustration and explanation. It should be understood that these modules are merely segregated based on their function for the sake of description and represent computer hardware and/or executable software code which can be stored on a computer-readable medium for execution on appropriate computing hardware. The various functions of the different modules and units can be combined or segregated as hardware and/or software stored on a non-transitory computer-readable medium as above as modules in any manner, and can be used separately or in combination.

The present invention is not limited to the precise construction and compositions disclosed herein; any and all modifications, changes, and variations apparent from the foregoing descriptions are within the spirit and scope of the invention as defined in the appended claims. Moreover, the present concepts expressly include any and all combinations and subcombinations of the preceding elements and aspects.

What is claimed:

1. An electronic gaming machine primarily dedicated to conducting at least one regulated casino wagering game, the electronic gaming machine comprising:

a gaming cabinet configured to house electronic components;

an electronic display device coupled to the gaming cabinet and configured to display the casino wagering game, the casino wagering game including a plurality of standard-sized symbol-bearing reels;

an electronic input device coupled to the gaming cabinet and configured to detect a physical item associated with monetary value that establishes a credit balance on the electronic gaming machine; and game-logic circuitry disposed within the gaming cabinet, the game-logic circuitry including a random element generator configured to generate one or more random elements associated with play of the casino wagering game, the game-logic circuitry being configured to:

initiate the casino wagering game in response to an input indicative of a wager drawn on the credit balance;

determine an outcome of the casino wagering game based, at least in part, on the one or more random elements generated by the random element generator;

change at least one of the standard-sized reels into a multi-reel carriage carrying a plurality of non-standard-sized symbol-bearing reels, each of the non-standard-sized reels being rotatably mounted to the multi-reel carriage;

direct the electronic display device to display the non-standard-sized reels spinning individually and contemporaneously with spinning of the standard-sized reels and the multi-reel carriage;

direct the electronic display device to display the outcome of the casino wagering game, the outcome including symbols borne by the standard-sized reels and the non-standard-sized reels populating a plurality of distinct array positions arranged in an array on the display device; and transmit an award to the player in response to the outcome meeting at least one predetermined award criterion.

2. The gaming machine of claim 1, wherein the multi-reel carriage is an expanded reel carriage replacing multiple neighboring ones of the standard-sized reels.

3. The gaming machine of claim 2, wherein the plurality of non-standard-sized symbol-bearing reels includes at least one mega-symbol-bearing reel, the at least one mega-symbol-bearing reel comprising a plurality of mega symbols.

4. The gaming machine of claim 3, wherein each of the mega symbols consists of a single, enlarged symbol that is configured to occupy multiple vertically adjacent array positions and multiple laterally adjacent array positions of the array.

5. The gaming machine of claim 3, wherein the expanded reel carriage is indexed such that each of the mega symbols of the at least one mega-symbol-bearing reel, when part of the wagering-game outcome, only appears in its entirety in the array.

6. The gaming machine of claim 3, wherein the symbols borne by the at least one mega-symbol-bearing reel consists solely of mega symbols.

7. The gaming machine of claim 3, wherein the plurality of non-standard-sized symbol-bearing reels borne by the expanded reel carriage consists solely of multiple mega-symbol-bearing reels.

8. The gaming machine of claim 3, wherein the array includes columns of the distinct array positions, and wherein the non-standard-sized reels of the expanded reel carriage include a plurality of miniature symbol-bearing reels, each of the miniature symbol-bearing reels being operable to populate a subsection of a single one of the columns of the array.

9. The gaming machine of claim 3, wherein the array includes columns of the distinct array positions, and wherein the expanded reel carriage occupies multiple neighboring ones of the columns of the array.

10. The gaming machine of claim 1, wherein the array includes columns of the distinct array positions, and wherein the non-standard-sized reels of the multi-reel carriage includes at least one miniature symbol-bearing reel, the at least one miniature symbol-bearing reel being operable to populate a subsection of a single one of the columns of the array.

11. The gaming machine of claim 1, wherein the changing the at least one of the standard-sized reels into the multi-reel carriage includes progressively transforming the at least one standard-sized reel into the multi-reel carriage while the at least one standard-sized reel is spinning.

12. The gaming machine of claim 1, wherein the standard-sized reels rotate about a first axis and the non-standard-sized reels rotate about second axes distinct from the first axis.

13. The gaming machine of claim 1, wherein the multi-reel carriage rotates about a first axis and the non-standard-sized reels rotate about second axes distinct from the first axis.

14. A gaming system primarily dedicated to conducting at least one regulated casino wagering game, the gaming system comprising:

an electronic slot machine including a gaming cabinet, an electronic display device attached to the gaming cabinet, and an electronic input device attached to the gaming cabinet, wherein the gaming cabinet is constructed to house components associated with a wagering game, and the electronic input device is configured to detect a physical item associated with monetary value that establishes a credit balance on the gaming system, the wagering game including a plurality of standard-sized symbol-bearing reels;

a random element generator configured to generate one or more random elements associated with play of the wagering game; and game-logic circuitry configured to:

initiate the wagering game in response to an input indicative of a wager drawn on the credit balance;

determine an outcome of the wagering game based, at least in part, on the one or more random elements generated by the random element generator;

change at least one of the standard-sized reels into a multi-reel carriage carrying a plurality of non-standard-sized symbol-bearing reels, each of the non-standard-sized reels being rotatably mounted to the multi-reel carriage;

direct the electronic display device to display the non-standard-sized reels spinning individually and contemporaneously with spinning of the standard-sized reels and the multi-reel carriage;

direct the electronic display device to display the outcome of the casino wagering game, the outcome including symbols borne by the standard-sized reels and the non-standard-sized reels populating plural distinct array positions arranged in an array displayed on the display device; and transmit an award to the player in response to the outcome meeting a predetermined award criterion.

15. The gaming system of claim 14, wherein the array includes columns of the distinct array positions, and wherein the multi-reel carriage is an expanded reel carriage replacing multiple neighboring ones of the standard-sized reels and occupying multiple neighboring ones of the columns of the array.

16. The gaming system of claim 14, wherein the plurality of non-standard-sized symbol-bearing reels includes at least one mega-symbol-bearing reel, the at least one mega-symbol-bearing reel bearing plural mega symbols, each of the mega symbols consisting of a single symbol that occupies multiple vertically adjacent reel positions and multiple laterally adjacent reel positions on the at least one mega-symbol-bearing reel.

17. The gaming system of claim 14, wherein the plurality of non-standard-sized symbol-bearing reels consists solely of multiple mega-symbol-bearing reels, the symbols borne by the mega-symbol-bearing reels consisting solely of mega symbols.

18. The gaming system of claim 14, wherein the array includes columns and rows of the distinct array positions, and wherein the non-standard-sized reels of the multi-reel carriage includes at least one miniature symbol-bearing reel, the at least one miniature symbol-bearing reel being operable to populate a subset of the rows and a single one of the columns of the array.

19. The gaming system of claim 14, wherein the changing the at least one of the standard-sized reels into the multi-reel carriage includes progressively transforming multiple neighboring ones of the standard-sized reels into an expanded multi-reel carriage while all of the standard-sized reels are spinning.

20. A method of operating a gaming system primarily dedicated to playing at least one regulated casino wagering game, the gaming system including an electronic random element generator, game-logic circuitry, and an electronic gaming machine, the electronic gaming machine including a gaming cabinet, an electronic display device, and an electronic input device configured to detect a physical item associated with monetary value that establishes a credit balance on the gaming system, the gaming cabinet housing components associated with a casino wagering game, the wagering game including a plurality of standard-sized symbol-bearing reels, the method comprising:

receiving, from an electronic input device of the electronic gaming machine, an input indicative of a wager drawn on the credit balance to initiate the casino wagering game;

generating, in response to the input indicative of the wager, one or more random elements with the electronic random element generator;

determining, by the game-logic circuitry, an outcome of the casino wagering game based, at least in part, on the one or more random elements;

changing, in response to a triggering event during play of the casino wagering game, at least one of the standard-sized reels into a multi-reel carriage carrying a plurality of non-standard-sized symbol-bearing reels, each of the non-standard-sized reels being rotatably mounted to the multi-reel carriage;

displaying, on the electronic display device, the non-standard-sized reels spinning individually and contemporaneously with spinning of the standard-sized reels and the multi-reel carriage;

displaying, on the electronic display device, the randomly determined outcome of the casino wagering game, the outcome including symbols borne by the standard-sized reels and the non-standard-sized reels populating a plurality of distinct array positions arranged in an array on the display device; and transmitting, by the game-logic circuitry, an award to the player if the outcome of the casino wagering game meets at least one predetermined award criterion.

* * * * *